US011324261B2

(12) United States Patent
Dokas

(10) Patent No.: US 11,324,261 B2
(45) Date of Patent: May 10, 2022

(54) GARMENT

(71) Applicant: Tobias Lazarus Dokas, Brighton-Le-Sands (AU)

(72) Inventor: Lazarus Dokas, Brighton-Le-Sands (AU)

(73) Assignee: Tobias Lazarus Dokas, North Sydney (AU)

( * ) Notice: Subject to any disclaimer, the term of this patent is extended or adjusted under 35 U.S.C. 154(b) by 231 days.

(21) Appl. No.: 16/617,647

(22) PCT Filed: May 29, 2018

(86) PCT No.: PCT/AU2018/000081
§ 371 (c)(1),
(2) Date: Nov. 27, 2019

(87) PCT Pub. No.: WO2018/218275
PCT Pub. Date: Dec. 6, 2018

(65) Prior Publication Data

US 2020/0178619 A1 Jun. 11, 2020

(30) Foreign Application Priority Data

May 29, 2017 (AU) ..... 2017902028

(51) Int. Cl.
*A41B 9/00* (2006.01)
*A41D 7/00* (2006.01)

(52) U.S. Cl.
CPC ..... *A41B 9/002* (2013.01); *A41D 7/005* (2013.01)

(58) Field of Classification Search
CPC .. A41B 9/002; A41B 9/04; A41B 9/12; A41D 7/005; A41D 7/00; A61F 13/82
(Continued)

(56) References Cited

U.S. PATENT DOCUMENTS 2,443,474 A * 6/1948 Taylor ..... A41D 7/005 2/67
2,534,934 A * 12/1950 Viniegra ..... A61F 13/143 128/846

(Continued)

FOREIGN PATENT DOCUMENTS

AU 7590191 9/1991
WO 2009/141480 A1 11/2009

OTHER PUBLICATIONS

International Search Report dated Jun. 19, 2018 in corresponding international application No. PCT/US2018/000081.

(Continued)

*Primary Examiner* — Heather Mangine
(74) *Attorney, Agent, or Firm* — Browdy and Neimark, PLLC

(57) ABSTRACT

The present invention relates to a garment (1), and more particularly an underwear, sportswear or swimwear garment (1) for a female. The underwear, sportswear or swimwear garment comprises an open-sided structural frame (10) and a fabric covering (20) for the structural frame. The structural frame (10) includes an anterior contoured loop (15) and a posterior stem (12), relative to a wearer of the garment in normal use, wherein the anterior contoured loop (15) is adapted for surrounding the mons-pubis region, genitals and anus of a female wearer and has a perimeter that is contoured to conform to and engage with the anatomy of the female wearer. A portion of the perimeter of the anterior contoured loop (15) is adapted for tensioned engagement with the inner thigh muscles of a female wearer when worn, in a standing position or whilst walking. The posterior stem (12) is shaped so as to be engageable by the gluteus maximus muscles of the female wearer when worn. The anterior contoured loop (15) and the posterior stem (12) are formed in a sprung-biased arrangement relative to one another such that when (Continued)

the underwear, sportswear or swimwear garment (1) is worn on the female body, a tensile force is transferrable from the posterior stem to the anterior frame portion.

12 Claims, 22 Drawing Sheets

(58) Field of Classification Search
USPC ..... D2/712
See application file for complete search history.

(56) References Cited

U.S. PATENT DOCUMENTS 3,339,208 A * 9/1967 Marbach ..... A41D 7/005 2/67
3,705,575 A * 12/1972 Edwards ..... A61F 2/005 600/29
4,394,781 A * 7/1983 Axmann ..... A41D 7/005 2/238
D301,080 S * 5/1989 Gay, Jr. ..... D2/731
4,875,236 A * 10/1989 Boynton ..... A41D 7/00 2/67
D356,660 S * 3/1995 Leonard ..... D2/704
5,396,662 A * 3/1995 Leonard ..... A41D 7/005 2/400
5,467,482 A * 11/1995 Crawford, II ..... A41D 7/005 2/400
5,832,535 A * 11/1998 Davis ..... A41B 9/002 2/1
6,129,083 A * 10/2000 Jansen ..... A41B 9/002 128/846
6,490,732 B1 * 12/2002 Spoke ..... A41B 9/002 2/406
D484,671 S * 1/2004 Swan ..... A41B 9/002 D2/712
6,715,186 B1 * 4/2004 Huang ..... A41B 9/002 2/271
D540,508 S * 4/2007 Kushner ..... D2/712
D606,281 S * 12/2009 Caffejian ..... D2/712
9,560,889 B1 * 2/2017 White ..... A41D 7/001
10,441,001 B1 * 10/2019 Chase ..... A41B 9/04
2003/0187323 A1 * 10/2003 Goodman ..... A42B 7/00 600/38
2004/0064872 A1 * 4/2004 Ruiter ..... A41D 7/005 2/400
2004/0083537 A1 * 5/2004 Mosha ..... A41B 9/002 2/400
2004/0181857 A1 * 9/2004 Brinks ..... A43B 3/0078 2/424
2004/0244418 A1 * 12/2004 Smith ..... A44C 15/00 63/1.11
2006/0039165 A1 * 2/2006 Harris ..... A41D 7/00 362/605
2006/0281391 A1 * 12/2006 Martz ..... A41B 9/04 450/94
2007/0236916 A1 * 10/2007 Hsu ..... A41B 9/002 362/103
2008/0040830 A1 * 2/2008 Holland ..... A41D 7/005 2/67
2008/0134404 A1 * 6/2008 Sudarsky ..... A41B 9/001 2/67
2009/0205100 A1 * 8/2009 Flower ..... A41B 9/002 2/67
2010/0152687 A1 * 6/2010 Carlozzi ..... A61F 15/003 604/359
2010/0180359 A1 * 7/2010 Andrews ..... A41C 3/065 2/69
2011/0030128 A1 2/2011 Buettner
2012/0272427 A1 * 11/2012 Scozzafava ..... A41D 7/00 2/67
2014/0053309 A1 * 2/2014 Medina ..... A41D 7/00 2/67
2015/0320123 A1 * 11/2015 Kosmala ..... A41D 7/00 2/67
2017/0055613 A1 * 3/2017 Dames, III ..... A41F 15/002
2019/0125000 A1 * 5/2019 Silvas ..... A41B 9/14
2020/0178619 A1 * 6/2020 Dokas ..... A41D 7/005

OTHER PUBLICATIONS

Supplementary European Search Report dated Feb. 4, 2021 in corresponding European application No. EP 18 80 9685.

* cited by examiner

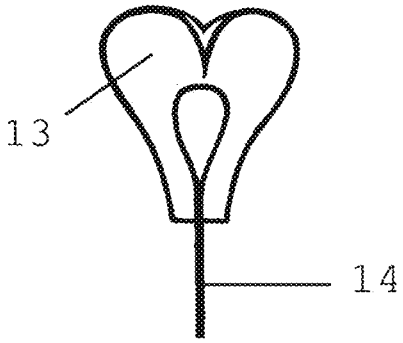
FIG.14
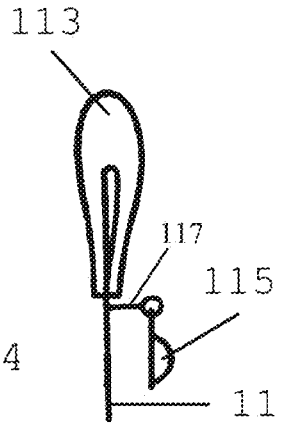
FIG.15A
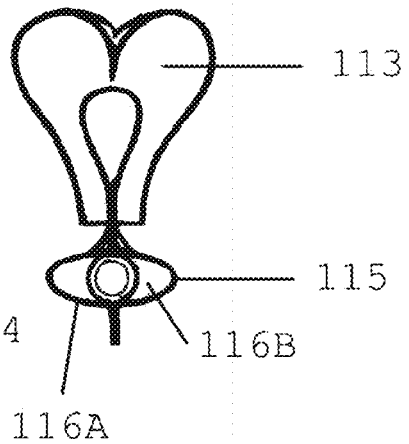
FIG.15B
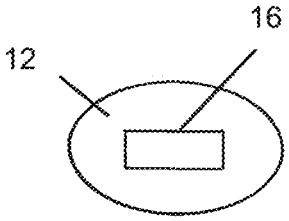
FIG.15C
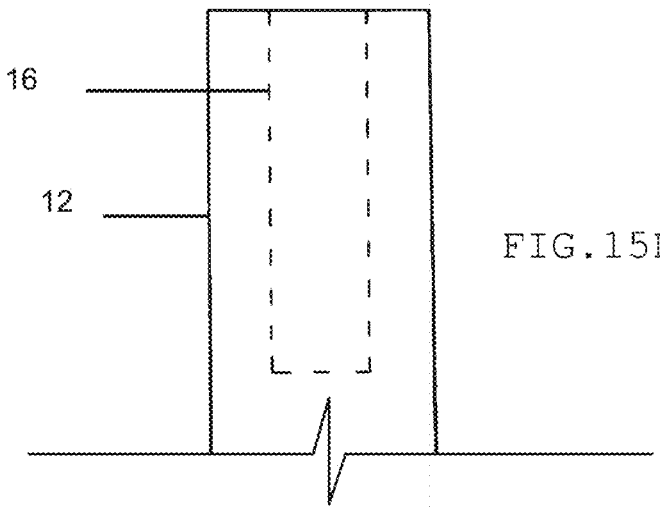
FIG.15D
FIG.16A
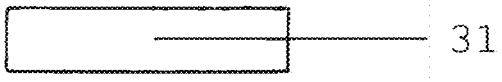
FIG.16B
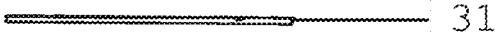
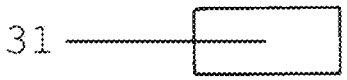
FIG. 17A
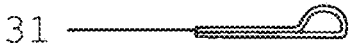
FIG. 17B

GARMENT

FIELD

The present invention relates to a garment, and particularly to a brief-type underwear sportswear or swimwear garment system for women. The garment can also be worn as an underwear garment whilst playing sport or performing extra-curricular activities.

BACKGROUND

Current conventional thong or G-string type underwear does not satisfy or meet the needs of modern day women in the developed and developing world. Women generally choose to wear thong or G-string type underwear when wearing clothing that clings to the body, for example tight fitting jeans or dresses, as this type of underwear can avoid unsightly underwear lines that may otherwise be visible through the wearer's clothing. However, current thong type underwear usually has a waist band or a band that sits at the wearer's hip which is often seen rising above the waistband of a pair of jeans or through a figure hugging dress. Nevertheless, thong type underwear is the only feasible underwear option other than a stick-on type of thong underwear such as that disclosed in US patent publication US20110030128. Such a solution is impractical for everyday use.

More importantly, thong type underwear options currently available can pose health risks to the wearer, of which the wearer is often oblivious, due to a lack of research or anecdotal evidence concerning the hazards or risks associated when wearing thong or G-string type underwear. This is of considerable concern as instances of health problems such as ovarian cancer and vaginal infections are increasing both in the developed and developing world.

A thong or G-string type underwear garment is generally constructed from a thin or thick strip of material that is in continuous contact with the anus, the vagina and the urethra of a female wearer of the garment. The thin or thick strip of cloth becomes a conduit that can increase the likelihood of transmission of bacteria and fecal matter from the anus to the urethra and/or from the vagina to the urethra. This is largely due to the design of thongs or G-strings, which are typically manufactured flat i.e. in two dimensions, yet are supposed to cover anatomy which is convex and bulbous in shape i.e. in three dimensions. It is due to this two-dimensional structure that they do not fit the wearer properly. The underwear garment slips in position on the wearer's body due to slippage caused by normal body movement. As a result, the thin or thick strip of material can often become wedged in the intergluteal cleft of the wearer, causing discomfort. The wearer has to adjust or reposition the thong or G-string, running the risk of cross contamination of bacteria caught on the thin or thick strip covering the anus with the urethra or vagina, increasing the risk of urinary tract infections (UTIs) by tracking bacteria from the rectal area into the urethra via the vagina. *E. Coli* (an enteric bowel bacteria), the most common bacteria found in the colon, is responsible for over 90% of UTIs. Similarly, bacteria can also be transferred from the vagina and urethra to the anus. The direction of the transfer of bacteria is dependent on which way the thin or thick strip of material travels, i.e. either towards the posterior (rear) or anterior (front) of the wearer's body.

It has been found that wearing thongs or G-string type underwear can cause or exacerbate a number of further health issues and conditions. These include the thong material rubbing the highly sensitive skin causing "skin tags" (small piles of soft tissue that occur from the skin being constantly rubbed by fabric in the same spot) in the exact distribution of the thong or G-string. Skin tags look like warts and can be especially uncomfortable in the vaginal area. Wearing a tight-fitting thong day after day can irritate and inflame the area around the Bartholin's glands, including ducts which produce lubrication during intercourse. If the ducts get clogged, a cyst next to the vagina could also develop. Thongs or G-strings made of man-made fibers, for example synthetic fibers, trap moisture and generate heat, creating an ideal host environment for bacteria to become prolific or multiply. Pregnant women who wear thongs or G-strings during pregnancy are at higher risk of infection in their female reproductive system. Pregnancy compromises the immune system which can increase the risk of vaginal infection. Thongs and G-strings are anecdotally linked to external hemorrhoids, due to possible chaffing of anal tissues. Thongs and G-strings can exacerbate hemorrhoids when the thong is caught in the intergluteal cleft, which can irritate the rectum and further inflame hemorrhoids. Other side effects of thong or G-string use includes thrush and cystitis. Gynecologists have found both conditions to be most common amongst women who wear thongs or G-strings.

In light of the above, there is a need for an underwear or sportswear garment which is largely invisible when worn under tight clothing, which readily conforms or matches the female pelvic anatomy, which does not move during body movement, provides an acceptable level of comfort and adequate ventilation and protection from leakage at the same time, provides adequate coverage through normal or active body movements, and which provides protection from infection caused by cross contamination between anatomical orifices (anus, vagina and urethra).

It is an object of the invention to substantially meet at least one of the above needs, at least to an extent.

SUMMARY OF INVENTION

According to the invention, there is provided an underwear, sportswear or swimwear garment for a female, comprising an open-sided structural frame and a fabric covering for the structural frame, the structural frame including an anterior contoured loop and a posterior stem, relative to a wearer of the garment in normal use, wherein the anterior contoured loop is adapted for surrounding the mons-pubis region, genitals and anus of a female wearer and has a perimeter that is contoured to conform to and engage with the anatomy of the female wearer; wherein a portion of the perimeter of the anterior contoured loop is adapted for tensioned engagement with the inner thigh muscles of a female wearer such that, when worn, a compressive force is applied to the perimeter by the inner thighs of the wearer in a standing position or whilst walking; wherein the posterior stem is shaped so as to be engageable by the gluteus maximus muscles of the female wearer when worn; and wherein the anterior contoured loop and the posterior stem are formed in a sprung-biased arrangement relative to one another such that when the underwear or swimwear garment is worn on the female body, a tensile force is transferrable from the posterior stem to the anterior frame portion.

The underwear sportswear or swimwear garment accordingly provides a comfortable and discreet underwear having a frame that is engineered to conform to the anatomy of the female body and to also utilise forces naturally applied by the wearer to provide a self-supporting garment in all postures or body movements. Specifically, a compressive force applied by the inner thighs to the structural frame assists in keeping the garment in place on the wearer in standing or walking positions and postures. The tensile force transferred from the posterior stem to the anterior frame portion anchors the garment in position in all postures or body movements. The underwear sportswear or swimwear garment does not slip with natural movement of the wearer, therefore the fabric covering does not travel, reducing the risk of the transfer of bacteria between the anus and the vagina and urethra. The structural frame is open-sided, avoiding a visible pant line through tight clothing.

In an embodiment, the underwear, sportswear or swimwear garment further comprises a protective end piece at a distal end of the posterior stem, the protective end piece being adapted for engagement with the sacrum of the wearer for the prevention of substantial movement of the underwear or swimwear garment towards the intergluteal cleft when worn on the female body. In a preferred embodiment, the protective end piece is heart shaped. The protective end piece may be made from medical grade silicone or UV stabilized polyurethane. Accordingly, even if the wearer is not using her gluteus maximus muscles to engage the posterior stem, the garment will not slip substantially in position, making it comfortable and reassuring to wear. The protective end piece both provides comfortable support to the sacrum when sitting or standing up against hard surfaces and also prevents the wearer from injury from the end of the posterior stem.

In an embodiment, the perimeter of the anterior contoured loop comprises an anterior portion adapted for surrounding the mons-pubis region and an inferior portion adapted for surrounding the labia majora and anus. The anterior portion may comprise an upper laterally concave portion flanked by left and right side anterior winglets adapted for engaging the lateral extent of the mons-pubis region, and a lower tapered portion adapted to fit the lower mons-pubis region of the wearer.

In an embodiment, a perimeter of the inferior portion includes a parabolic curvature adapted for close engagement with the inner thigh muscles of the wearer when worn on the female body. This positive and negative curvature of the perimeter of the frame between the vaginal and anal regions, which are adapted to fit the anatomy of the wearer, ensures that the garment will not slip backwards and forwards during normal movement. The perimeter of the inferior portion preferably also includes a pair of left and right side posterior winglets adapted for surrounding the sphincter muscle region surrounding the anus.

Preferably, the posterior stem is formed from the merging of the left and right side portions of the inferior portion of the contoured loop posteriorly of the posterior winglets, the posterior stem being adapted for following the intergluteal cleft and curve of the tail bone of a female wearer. In this manner, the compressive force applied by the gluteus maximus muscles of the wearer in an anatomical standing or sitting position helps to anchor the underwear garment in place and prevents it from slipping.

Preferably, the protective end piece is reinforced with a pin. In an embodiment, the pin is made of 316 marine grade stainless steel. Preferably, the fabric covering is made of cotton, more preferably combed jersey cotton. This material is breathable and soft for maximum comfort to the wearer. The inner fabric covering may include hypoallergenic organic cotton wicking material liner adapted for wicking moisture away from the body of the wearer.

Preferably, the structural frame is formed from a single injection molded piece of material, more preferably polycarbonate material.

In an embodiment, the sportswear or swimwear garment includes one or more straps for joining the anterior winglets to the protective end piece.

BRIEF DESCRIPTION OF DRAWINGS

FIG. 14 is a schematic view of a first embodiment of a protective endpiece of the underwear garment of FIG. 1;

FIGS. 15*a* and 15*b* are schematic views of a second embodiment of a protective endpiece of the sportswear or swimwear garment of FIG. 9; FIG. 15*c* is an enlarged schematic plan view of the posterior stem showing a keyway or socket for receiving the protective endpiece; FIG. 15*d* is an enlarged schematic elevation view of a distal end of the posterior stem, showing the hidden outline of the keyway or socket of FIG. 15*c* in broken lines;

FIG. 16*a* and FIG. 16*b* are partial schematic views of a first embodiment of an optional strap loop connector for use with the sportswear or swimwear garment of FIG. 1 or FIG. 9;

FIG. 17*a* and FIG. 17*b* are schematic views of a strap for use with the sportswear or swimwear garment of FIG. 1 or FIG. 9;

DESCRIPTION OF EMBODIMENTS

Figure 1:
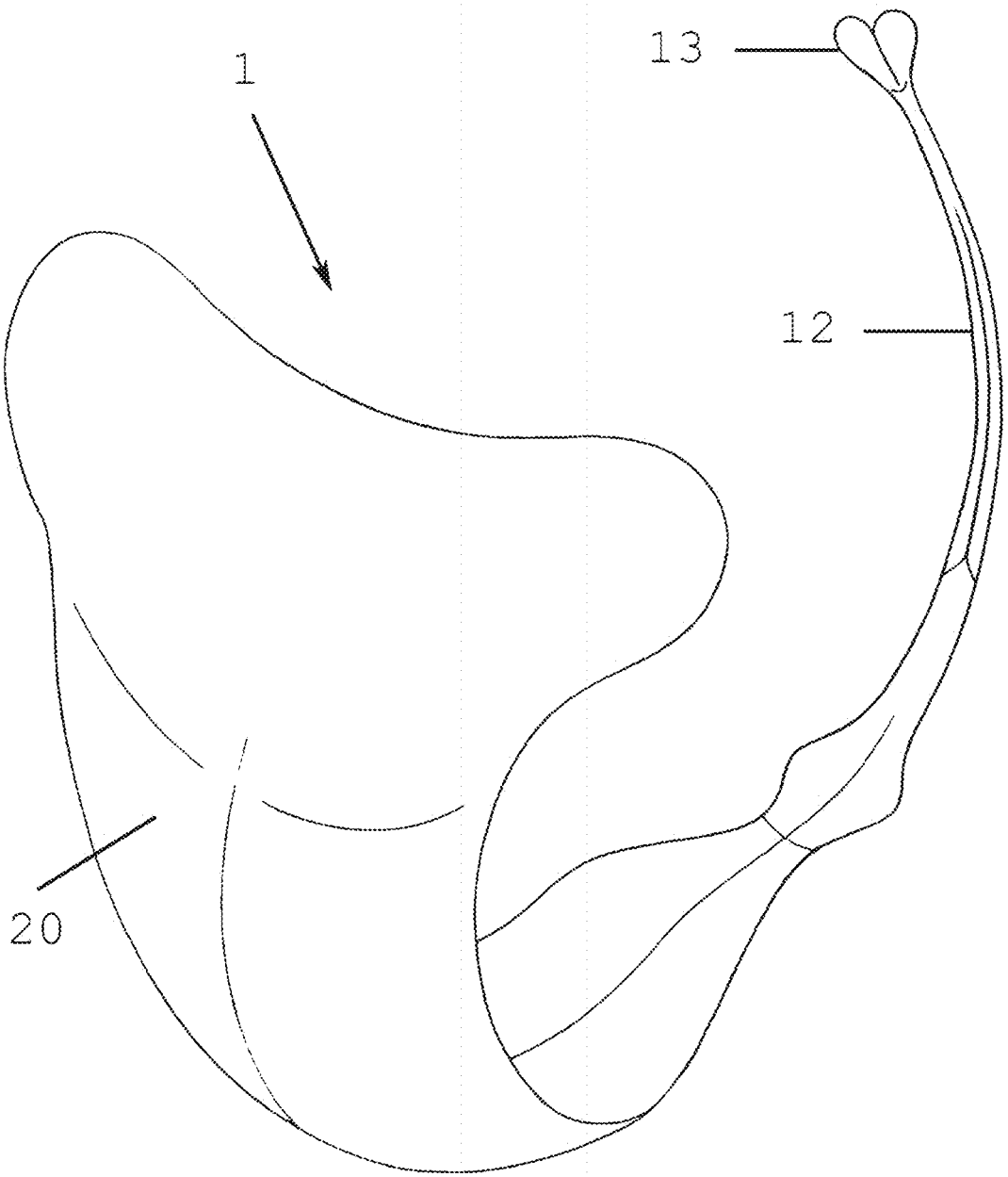
FIG. 1 is a perspective view of a first embodiment of an underwear, sportswear or swimwear garment in accordance with the invention.
Figure 6:
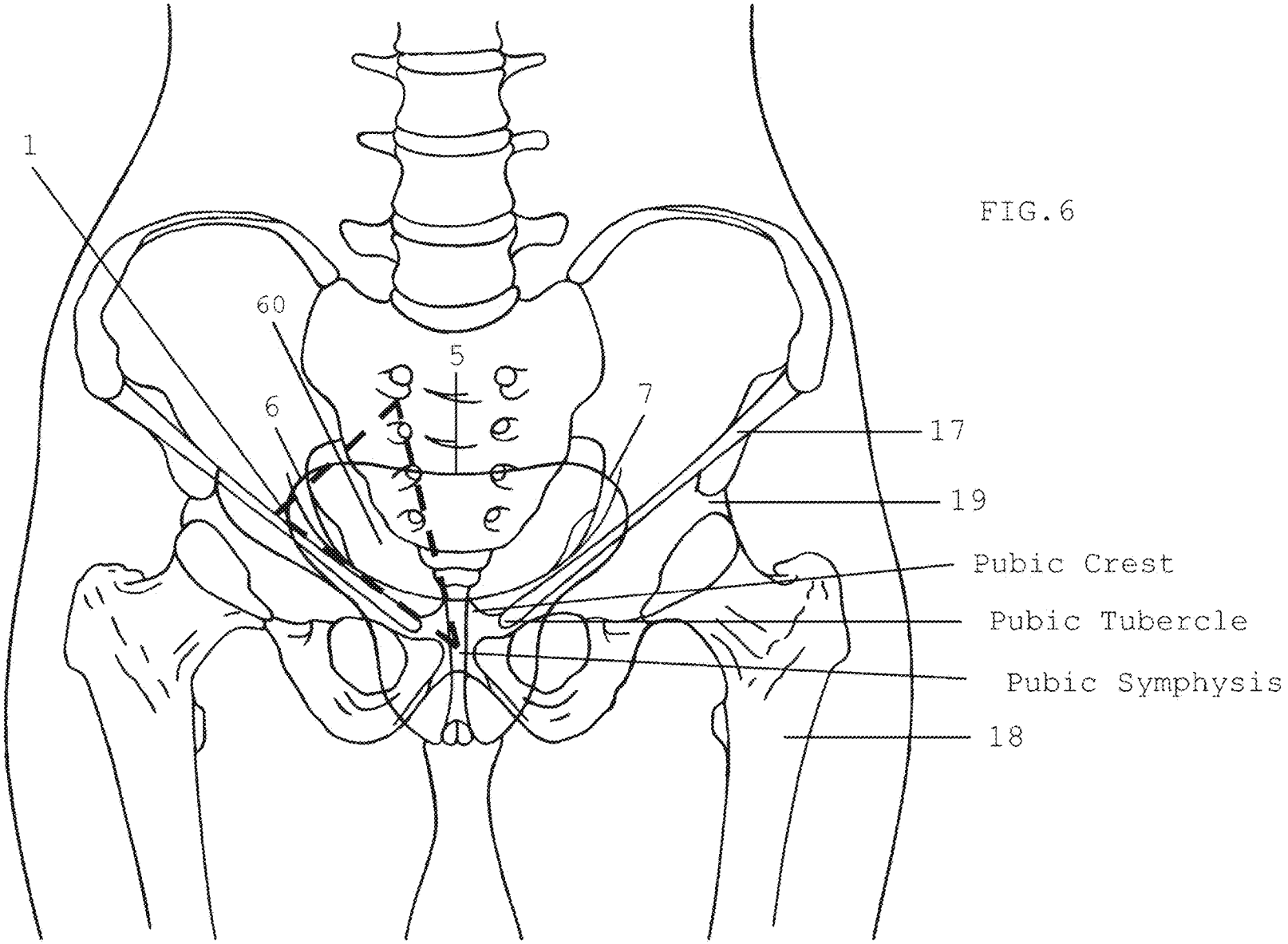
FIG. 6 is a schematic partial front view of a female skeleton with the outline of the structural frame of the underwear, sportswear or swimwear garment of FIG. 1 superimposed thereon.

FIGS. 1 to 7 are schematic views of a first embodiment of an underwear, swimwear or sportswear garment 1 (hereinafter referred to as the underwear garment 1 for brevity) according to the invention, with FIG. 6 showing a schematic front view of a female skeletal system and body outline, with the outline of the underwear, sportswear and swimwear garment 1 superimposed thereon. The underwear, sportswear or swimwear garment 1 is a brief type garment i.e. it is designed to cover the mons-pubis region, genitals and anus of the wearer and is comprised of a structural frame 10, best seen in FIGS. 2 and 3 and a soft fabric covering 20, seen in FIGS. 1 and 4. The structural frame 10 consists of a single continuous piece of injection molded polycarbonate that is shaped into a contoured loop 15, the ends of which merge to form a posterior stem 12. The contoured loop 15 has a perimeter that is adapted to sit on the body of the wearer and to be covered by the soft fabric covering 20 to provide coverage for the wearer's pubic region, genitals and anus. The posterior stem 12 helps to anchor the underwear, sportswear or swimwear garment 1 in place on the wearer and is also covered by the fabric covering 20. The contoured loop 15 of the structural frame 10 has an anterior portion 30 and an inferior portion 40 relative to the wearer. The anterior portion 30 and the posterior stem 12, bridged by the inferior portion 40, are formed so as to curve convexly outward from one another in a sprung-biased arrangement when viewed from the left or right side of the structural frame 10, as seen in FIG. 1 and also in FIG. 8, which shows a second embodiment of the underwear, sportswear or swimwear garment 100 that is identical to the first embodiment 1 in this regard.

The anterior portion 30 of the contoured loop 15 includes an upper frame portion 5 that extends laterally across the mons-pubis region when worn, and a lower tapered portion adapted to fit the lower mons-pubis of the wearer. When viewed from the front of the garment 1, the upper frame portion 5 has a gentle concave curvature across its lateral extent that curves inwardly toward the body of the wearer at the lateral extents thereof and which also has a gentle concave profile in the vertical direction so as to be a close fit to the mons-pubis region of the female body. The lateral extents of the upper frame portion 5 form rounded anterior winglets 6, 7 that are designed to sit at the lateral extent of the mons-pubis region. The anterior winglets 6, 7 evenly distribute a tensional force laterally across the upper portion 5 of the structural frame 10, providing strength to the frame 10 and covering the mons-pubis region of the wearer in a sprung-biased arrangement. The contoured profile of the anatomically correct anterior portion 30 allows the structural frame 10 to stay in position without the need for a full waistband. Accordingly, the underwear, sportswear or swimwear garment 1 is open-sided. The cross-sectional profile of the anterior portion 30 of the structural frame 10 varies throughout the perimeter of the contoured loop 15 and is flattest in the region encompassing the mons-pubis region to minimise the profile of the structural frame 10 for added comfort and flexibility for the wearer of the underwear, sportswear or swimwear garment 1 as well as for concealing the garment when wearing tighter fitting clothing.

The anterior lateral winglets 6, 7 engage the structural frame 10 on the wearer when worn, allowing for a full range of body movements. The winglets 6, 7 anchor the underwear, sportswear or swimwear garment 1 in place on the wearer above the socket joining the leg bones 18 to the pelvis 19, above the inguinal ligament 17 in the region of the Hasselbachs triangle 60 and thereby resist downward movement of the underwear, sportswear or swimwear garment 1 whilst the body is experiencing more extreme postures, for example whilst the legs are spread wide during sport, swimming or other exercise.

Below the anterior winglets 6, 7 the anterior portion 30 of the contoured loop 15 narrows laterally towards the genitals and then curves with a convex curvature outwardly and rearwardly towards the posterior of the wearer, the perimeter encompassing the labia and genitals at a genital portion 25 of the inferior portion 40 at which the left and right sides of the interior portion 40 of the contoured loop 15 taper towards one another, and then curve both rearwardly and convex outwardly and upwardly towards the anus of the wearer. The perimeter of the contoured loop 15 then curves concave inwardly such that the perimeter narrows laterally before curving convex outwardly again to form posterior winglets 42 that surround the anal region of the wearer, including the sphincter muscle, when worn. Rearwardly of the posterior winglets 42, the left and right sides of the contoured loop 15 curve upwardly, tapering with a concave curvature along the mid-sagittal plane, mirroring the curvature of the gluteus maximus muscles, and merge together along a mid-sagittal plane of the wearer to become the single stem 12.

Figure 4:
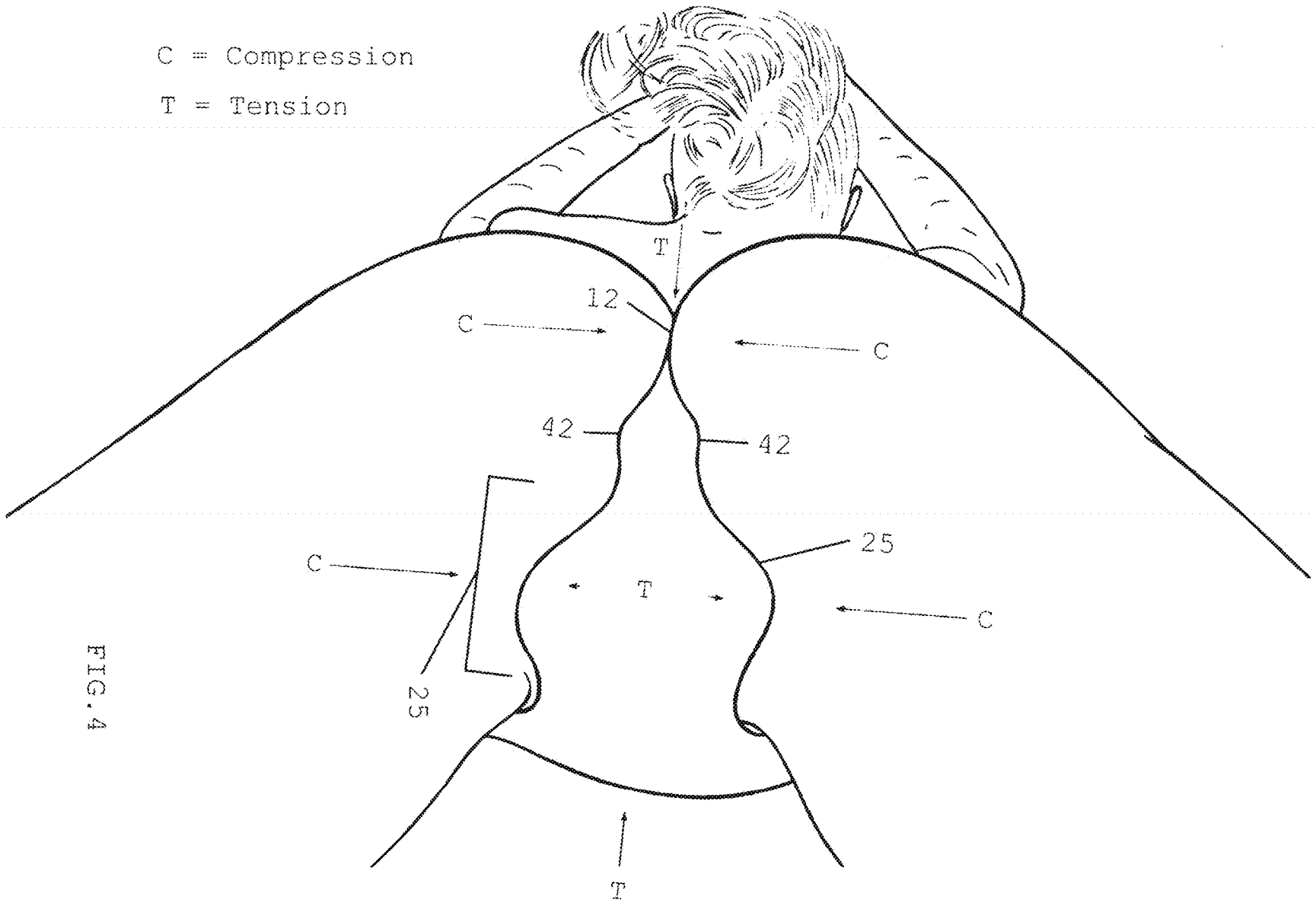
FIG. 4 is an inferior view of the underwear, sportswear or swimwear garment of FIG. 1 in situ on a female wearer of the garment.
Figure 5:
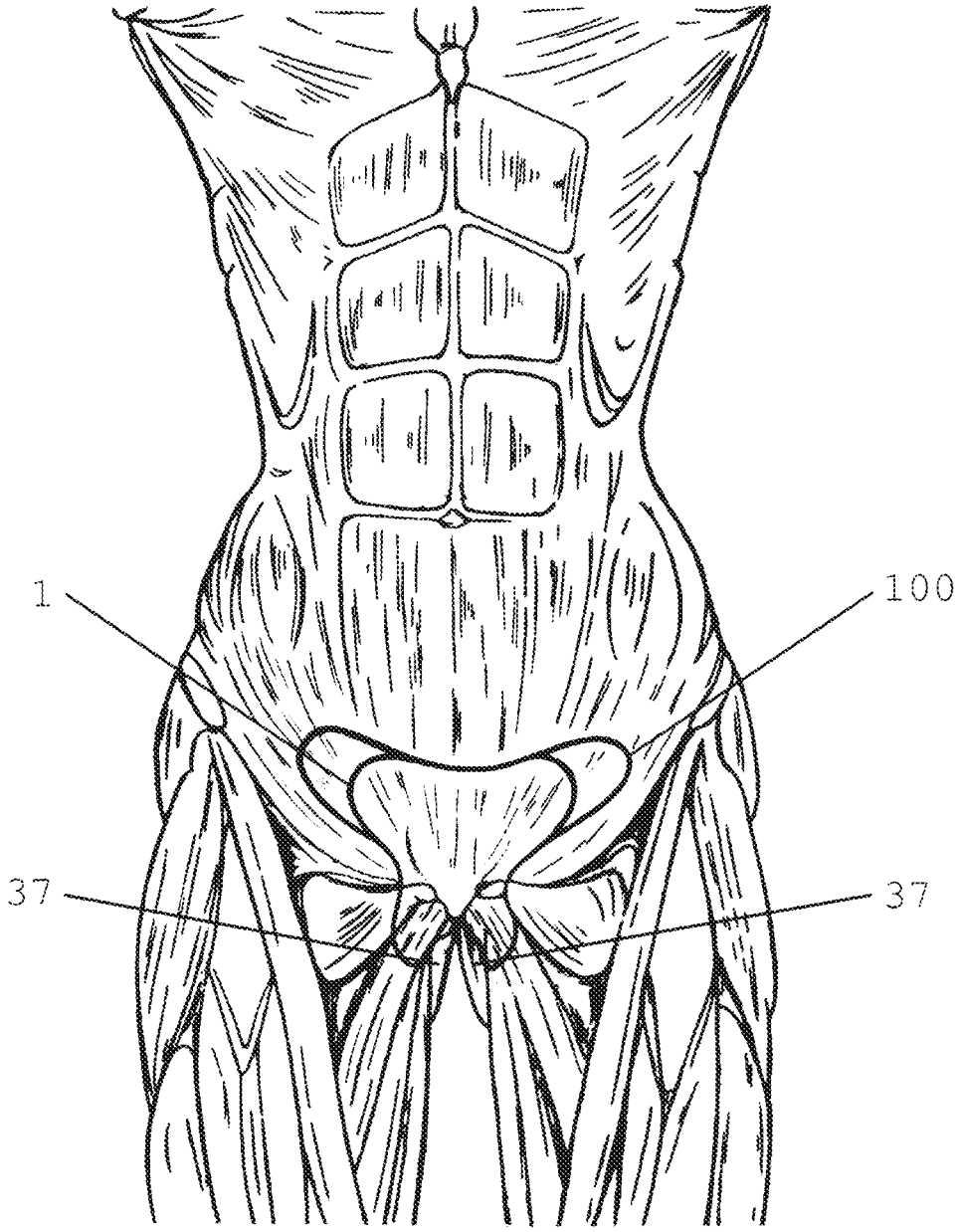
FIG. 5 is a schematic partial front view of the female muscular system, showing the outline of the structural frame of the underwear, sportswear or swimwear garment of FIG. 1 outlined thereon.

As such, the shape of the anterior portion 30 and the interior portion 40 of the structural frame 10 has a curved profile that fits closely but comfortably over the pubic region and is, at its lowermost portions, e.g. at the inferior genital portion 25, shaped with a parabolic curvature to conform to the female anatomy and be engageable by the thigh muscles of the wearer in a normal standing, sitting or walking posture, so as to exert a compressive force "C" thereon, as shown in FIG. 4. The structural frame at the inferior genital portion 25 has an inbuilt tensile force "T" across its lateral extent, therefore the wearer exerting a compressive force on the frame effectively spring-biases the underwear, sportswear or swimwear garment 1 in position on the wearer.

Figure 2:
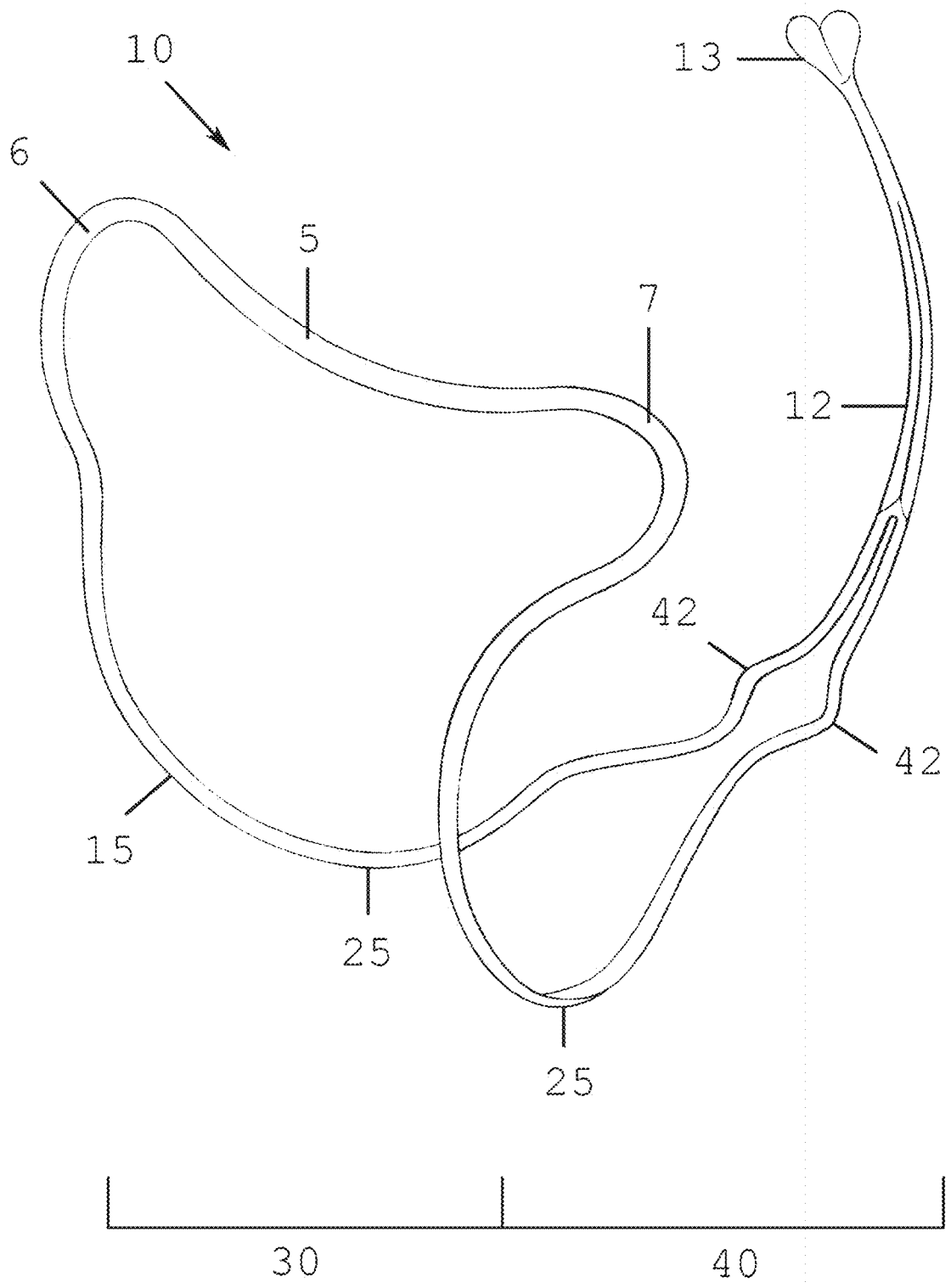
FIG. 2 is a perspective view of the structural frame of the underwear, sportswear or swimwear garment of FIG. 1.
Figure 3:
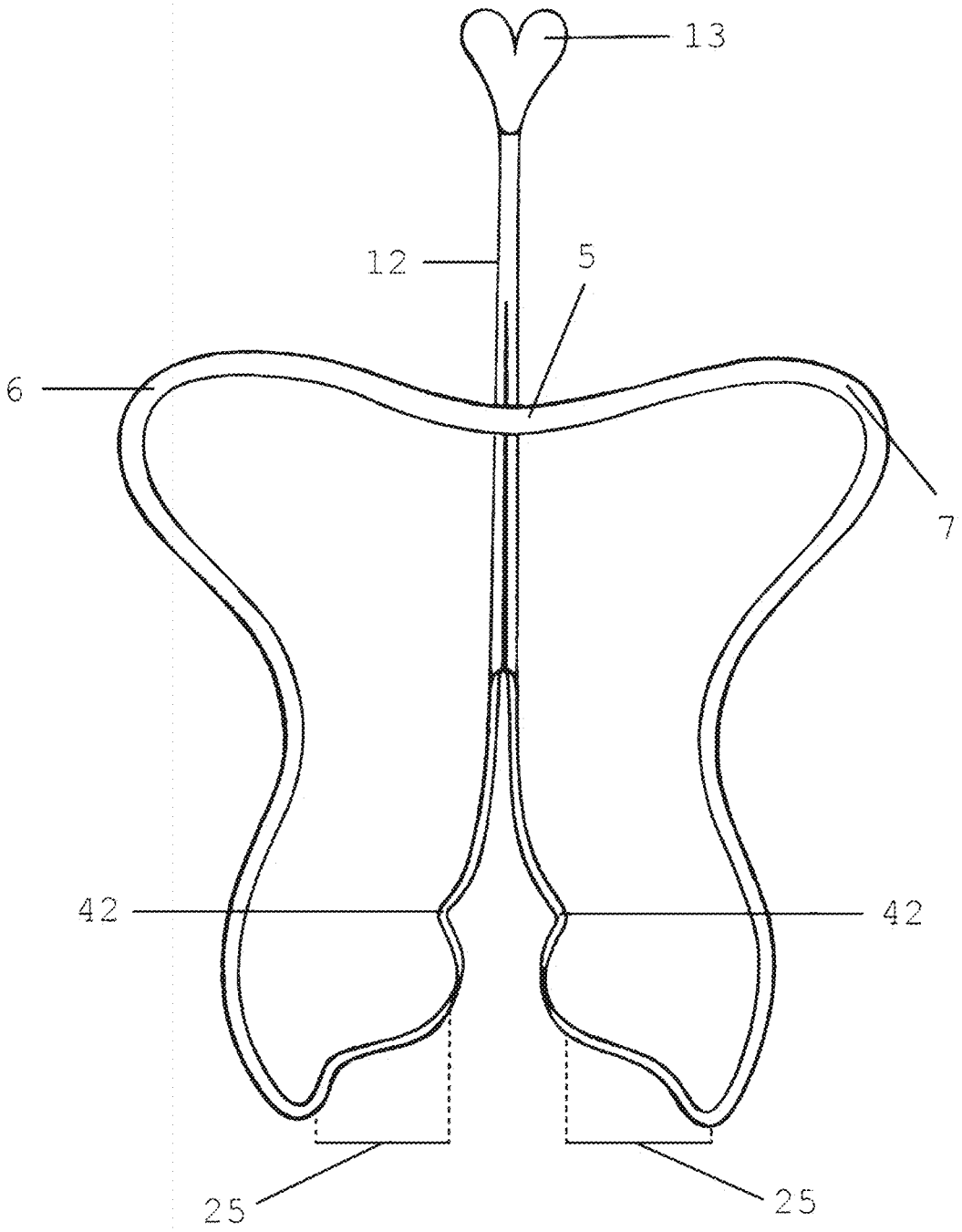
FIG. 3 is a front view of the structural frame of the underwear, sportswear or swimwear garment of FIG. 1.
Figure 7:
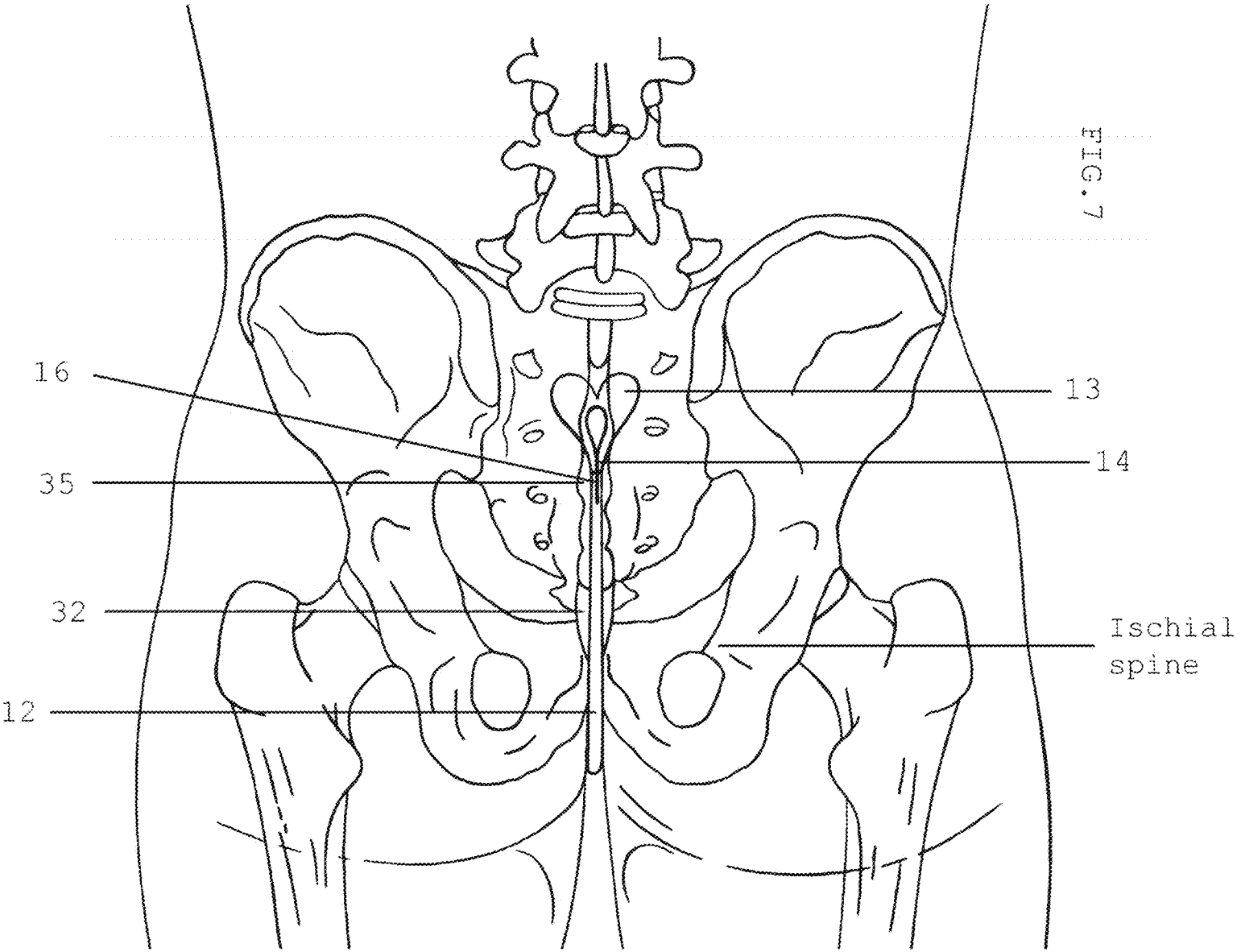
FIG. 7 is a schematic partial rear view of the female skeleton showing an outline of the posterior portion of the structural frame of the underwear garment of FIG. 1 superimposed thereon.
Figure 8:
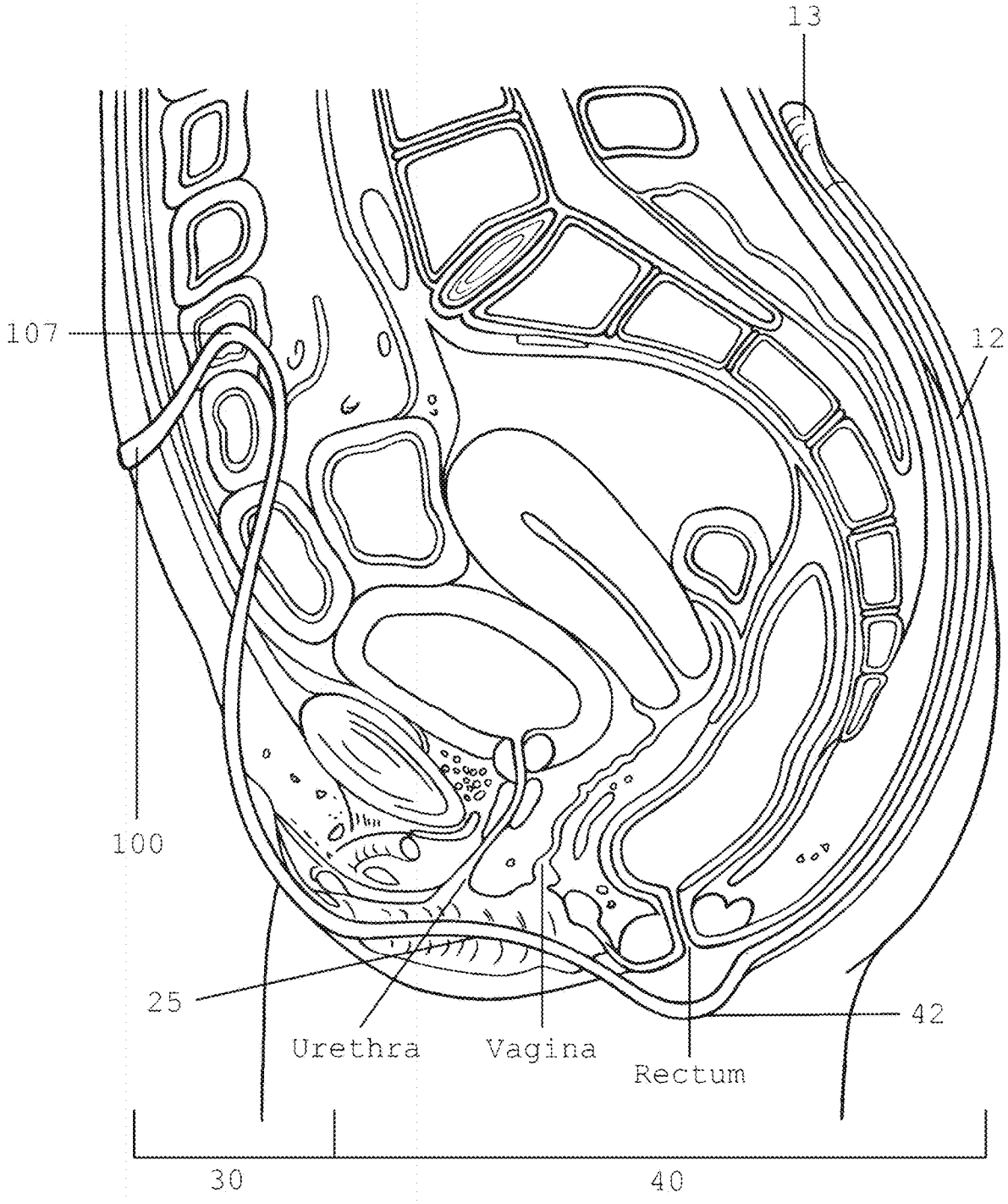
FIG. 8 is a side schematic view of the structural frame of the underwear garment of a second embodiment of the invention superimposed on a mid-sagittal cross-sectional view of the female anatomy.
Figure 9:
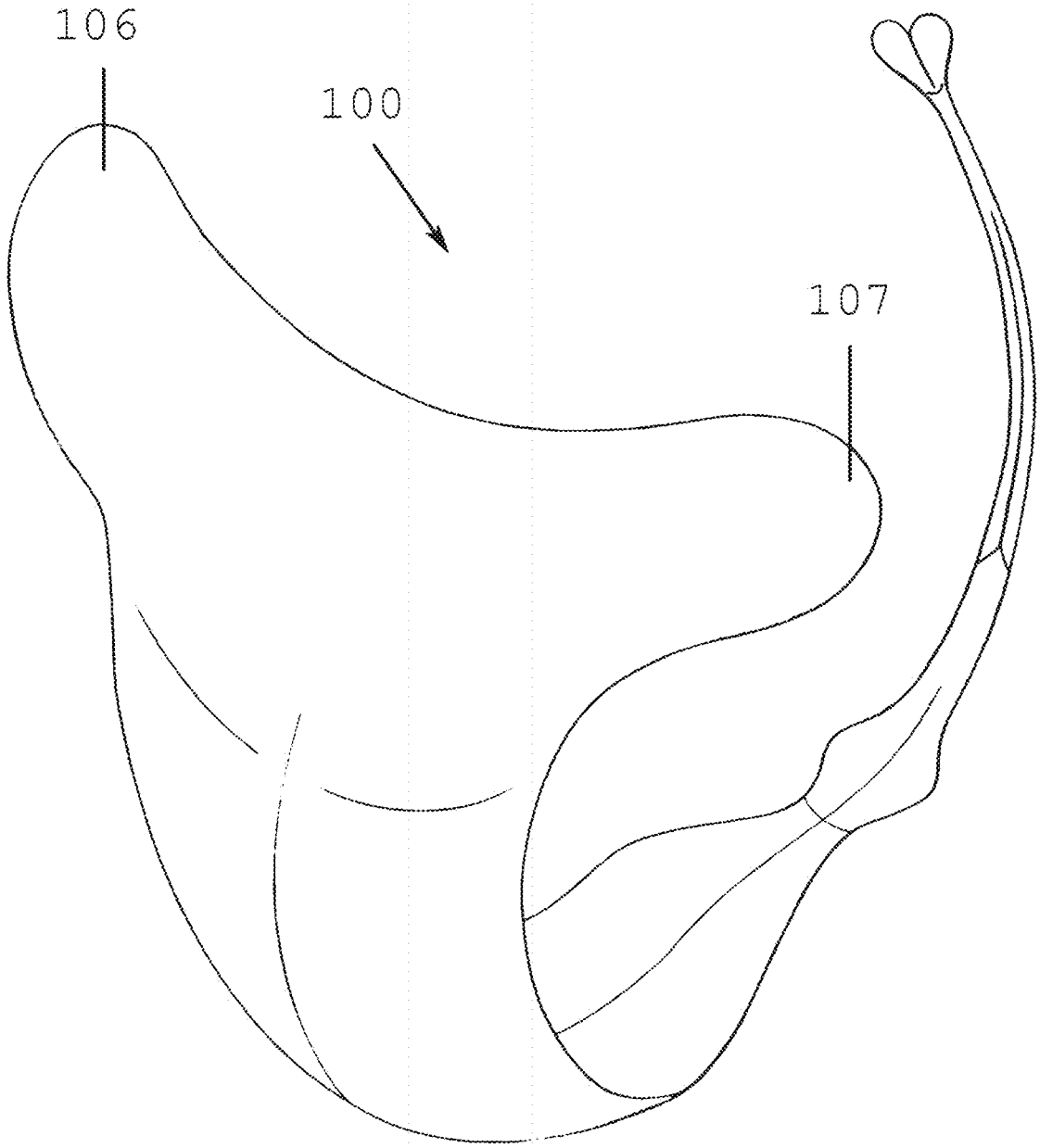
FIG. 9 is a perspective view of a second embodiment of an underwear sportswear or swimwear garment in accordance with the invention.
Figure 10:
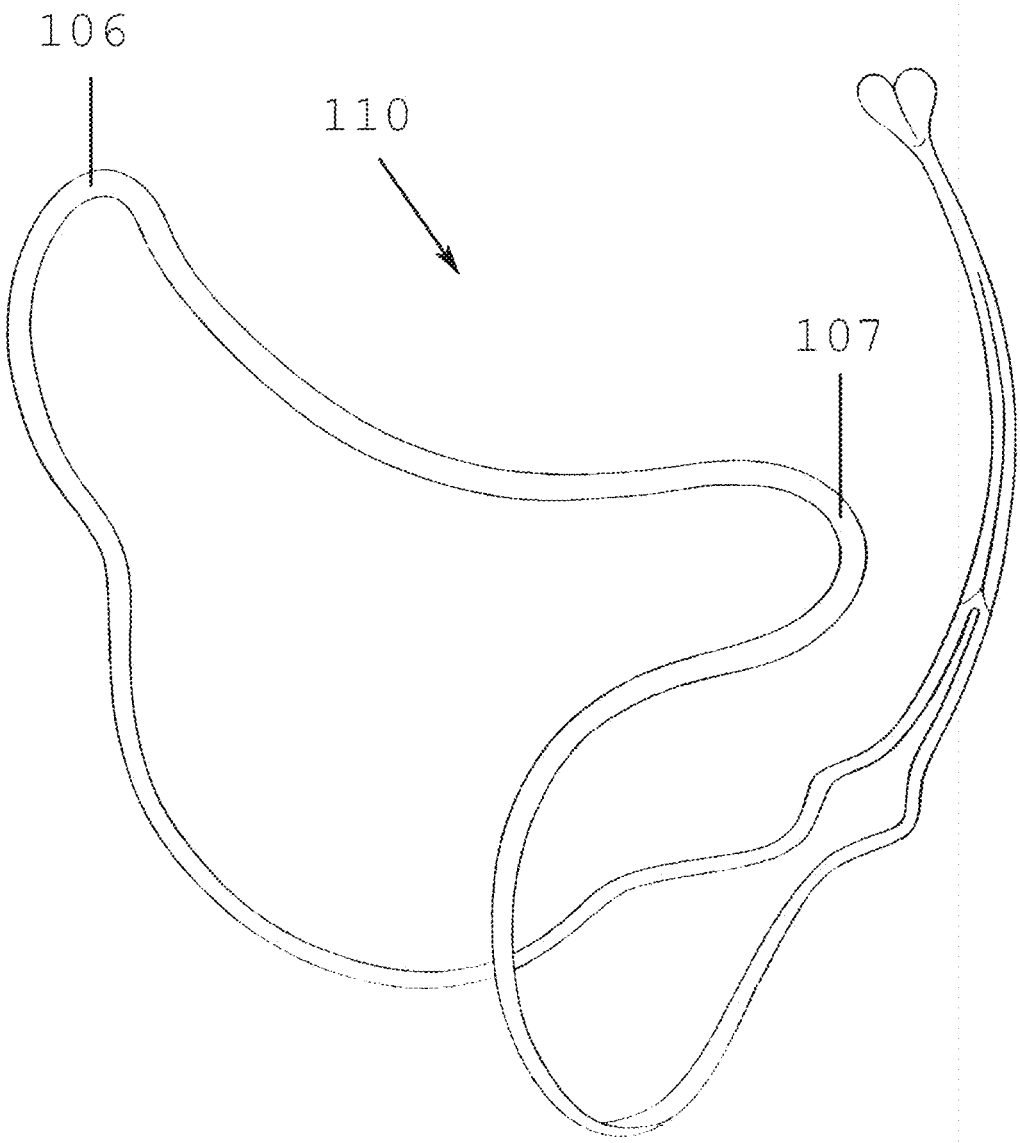
FIG. 10 is a perspective view of the structural frame of the underwear, sportswear or swimwear garment of FIG. 9.
Figure 11:
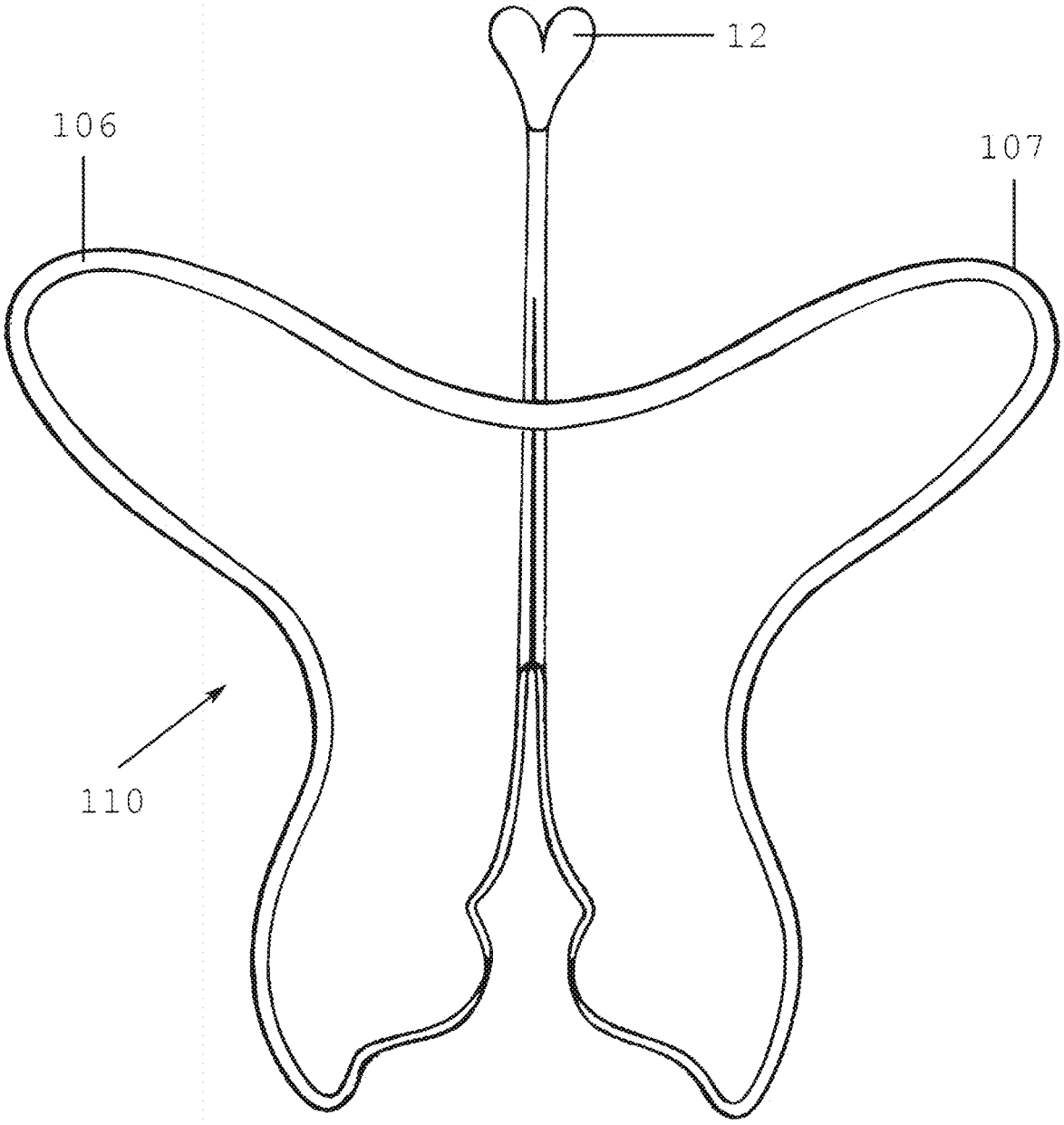
FIG. 11 is a front view of the structural frame of the underwear, sportswear or swimwear garment of FIG. 9.
Figure 12:
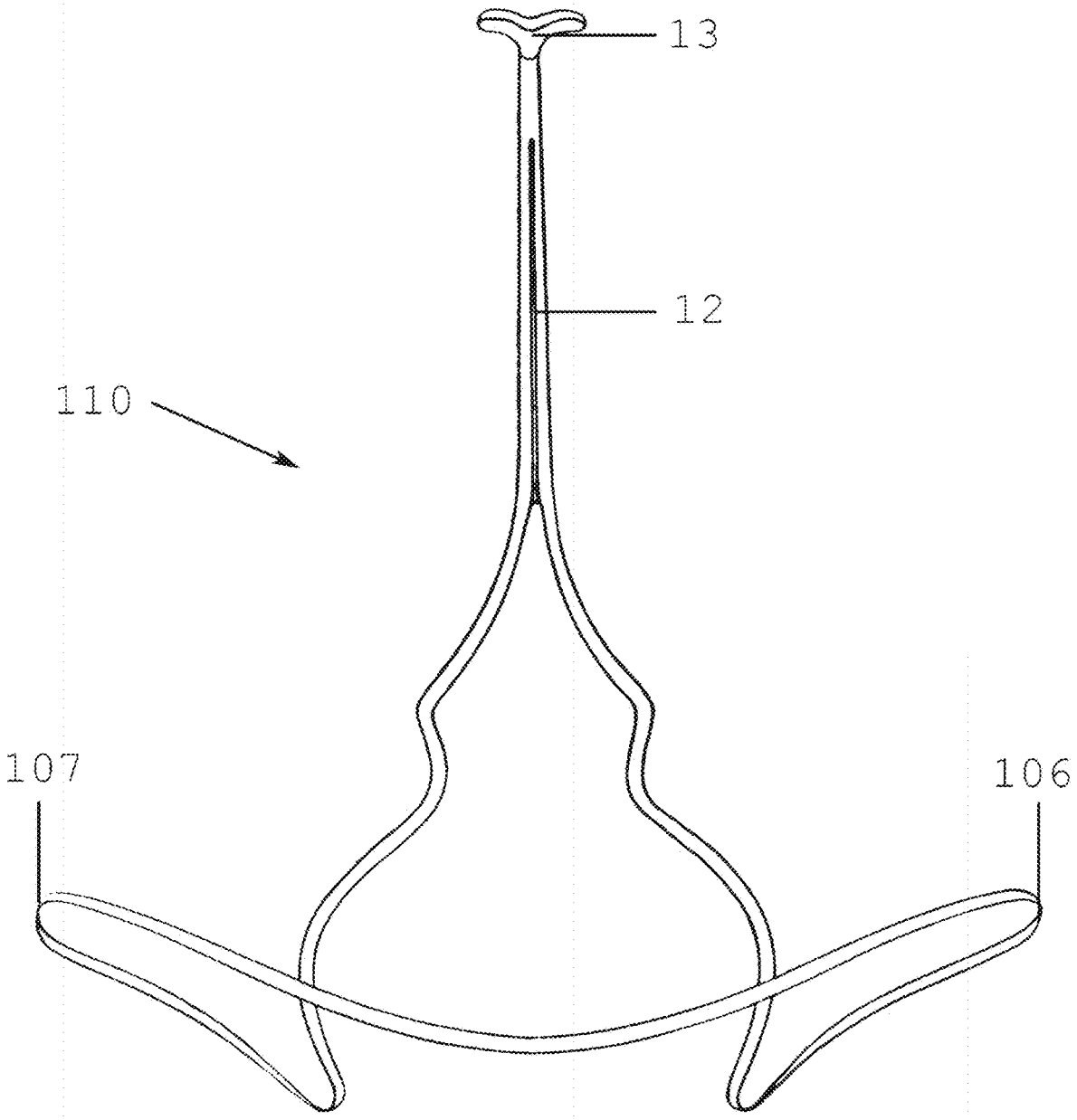
FIG. 12 is a plan view of the structural frame of the underwear, sportswear or swimwear garment of FIG. 9.

FIG. 7 is a schematic rear view of a female skeletal system and body outline showing the outline of a rear view of the underwear garment 1 superimposed thereon. The posterior stem 12 can be seen to extend along the intergluteal cleft of the body. As best seen in FIGS. 2 and 8, the posterior stem 12 tapers in width towards its distal end and has a convex curvature that follows the natural curve of the intergluteal cleft and the curve of the tailbone of the wearer from the coccyx 32 to the sacrum 35. The posterior stem 12 is anchored by compressive forces activated by the gluteus maximus muscles 37 in normal standing or walking postures.

The posterior stem 12 is held under a further tensional force when the underwear garment 1 is worn, compared to the single tensional force applied to the perimeter of the contoured loop 15 of the structural frame 10 as a result of the compressive force applied by the gluteus maximus muscles 37 of the wearer as described above. The underwear garment 1 stays in place on the wearer in part due to the spring bias between the anterior portion 30 and the posterior stem 12. A tension force is applied to the anterior portion 30 by the posterior stem 12, transferring tensile force from the posterior stem 12 through the inferior portion 40 to the anterior portion 30 of the structural frame 10. This constant transference of tensile force from the posterior to the anterior of the structural frame 10 ensures that all postures of the wearer can be accommodated comfortably, helping to maintain the underwear garment in position even in extreme movements in which the gluteus maximus muscles 37 are relaxed, or when compressive forces acting from the gluteus maximus muscles 37 experienced through normal movements, for example walking or running, are no longer acting. The posterior stem 12 will maintain its anatomically correct position and will nevertheless remain close to the body of the wearer as a result of the tensile force created by the sprung-biased arrangement of the structural frame 10.

As seen in FIG. 1, the two perimeter portions forming the posterior stem 12 are glued or otherwise joined together and the posterior stem 12 is covered at its distal end by a protective end piece 13. As seen in FIG. 14, the protective end piece 13 is anchored to the posterior stem 12 by a stainless steel insert 14. A socket or keyway 16 in the distal end of the posterior stem 12, shown in FIGS. 15*c* and 15*d*, receives the insert 14 and ensures that the protective end piece 13 does not rotate, potentially causing discomfort to the wearer. The socket or keyway 16 has dimensions of approximately 0.5 mm by 2 mm area and 15 mm in depth. The protective end piece 13 comprises an injection molded medical grade silicone heart shape that is convex in profile providing comfortable support to the sacrum 35 of the wearer whilst functioning as a cushion to protect the wearer of the underwear garment 1 from discomfort when sitting against hard surfaces. When worn, the natural heart shape creates a small wedge at the intergluteal cleft and resists any major downward movement of the underwear garment 1 by wedging itself at the superior extent of the intergluteal cleft whilst at the same time maintaining a compressive force against the sacrum 35 caused by tensional force acting on the posterior stem 12. In an embodiment, the protective end piece 13 is made from medical grade silicone UV stabilized flexible polyurethane reinforced with a 316 marine grade stainless steel pin 14, which avoids staining caused by salt or freshwater. The protective end piece 13 also protects the wearer from potential injury from the sharp distal end of the key way 16.

Figure 13:
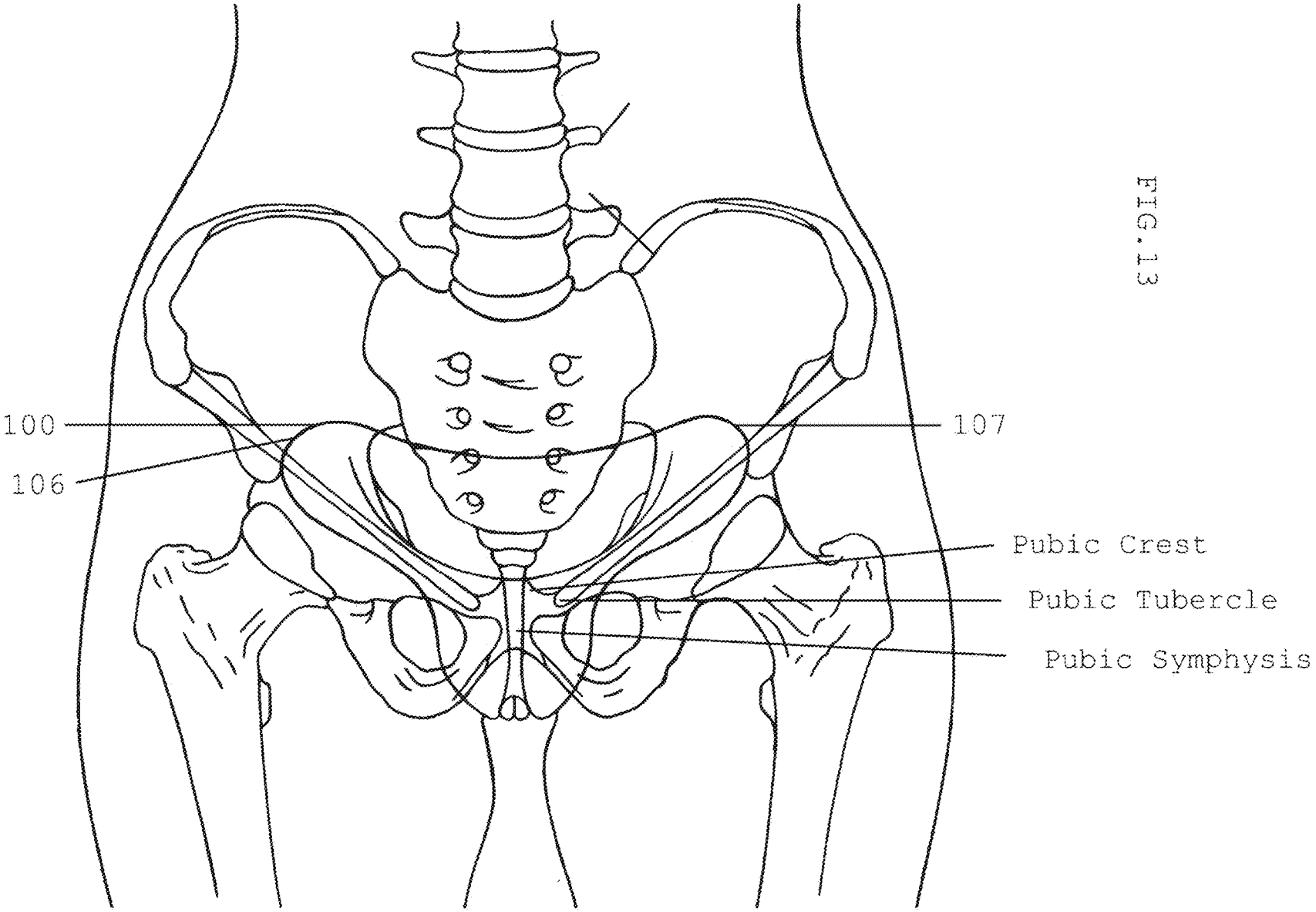
FIG. 13 is a schematic partial front view of a female skeleton with the outline of the structural frame of the underwear, sportswear or swimwear garment of FIG. 9 superimposed thereon.

FIGS. 8-13 show a second embodiment 100 of the invention, including FIG. 13 which shows the schematic female skeletal system of a female with the outline of the front view of the second embodiment 100 of the invention superimposed thereon. The anterior lateral winglets 106, 107 of the structural frame 110 of the second embodiment of the underwear garment 100 anchor the underwear garment 100 over a larger surface area, extending laterally further than the winglets 6, 7 of the first embodiment 1, to allow the wearer to engage in more rigorous activities including sports without the risk of the underwear garment 100 moving significantly out of place. The second embodiment is therefore more suited to swimwear or for wearing whilst engaging in sport or other exercise than the underwear garment 1. Otherwise, the first embodiment of the underwear garment 1 and the second embodiment of the underwear garment 100 are substantially identical.

Figure 18:
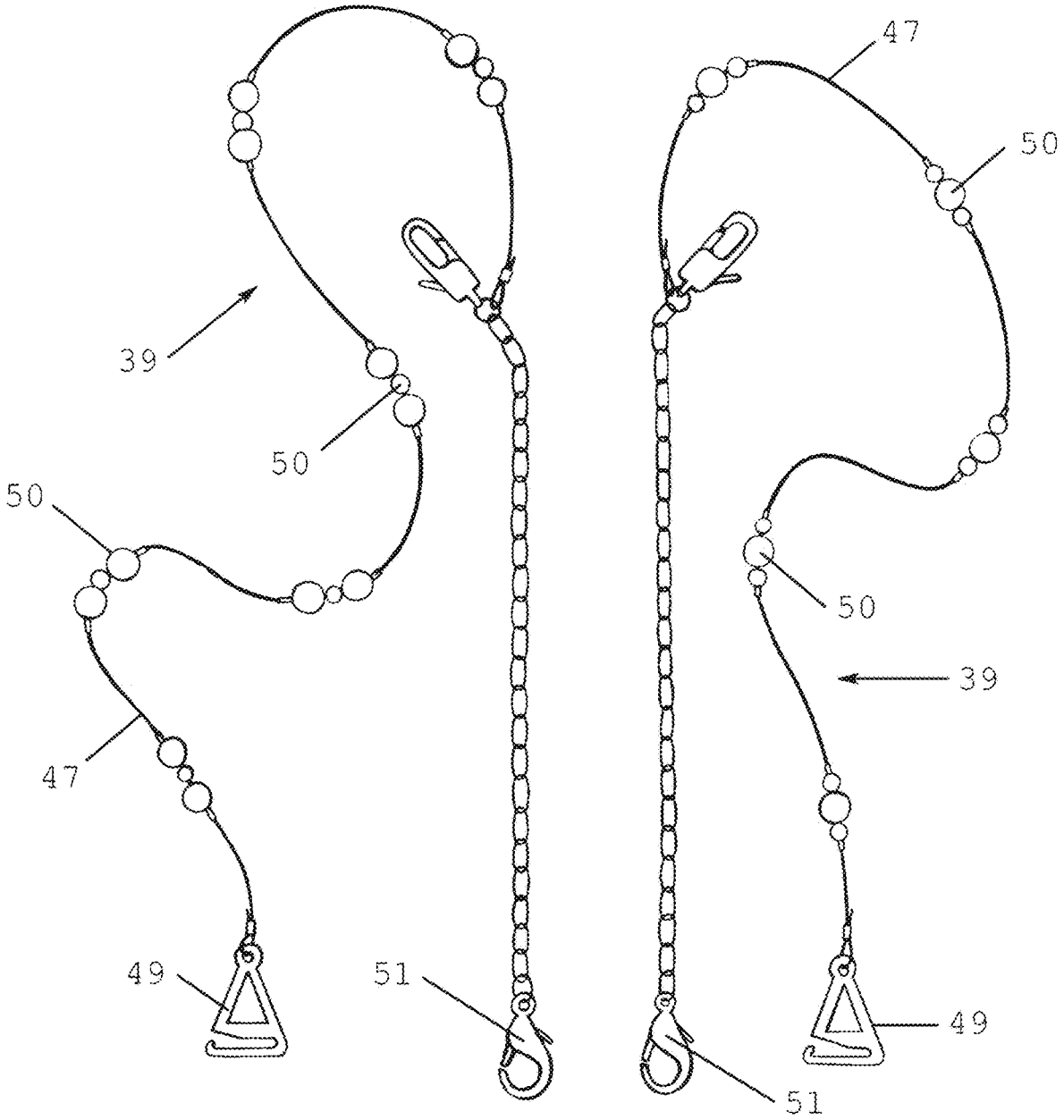
FIG. 18 is a schematic view of a second embodiment of an optional mono filament strap for use with the sportswear or swimwear garment of FIG. 9.
Figure 19:
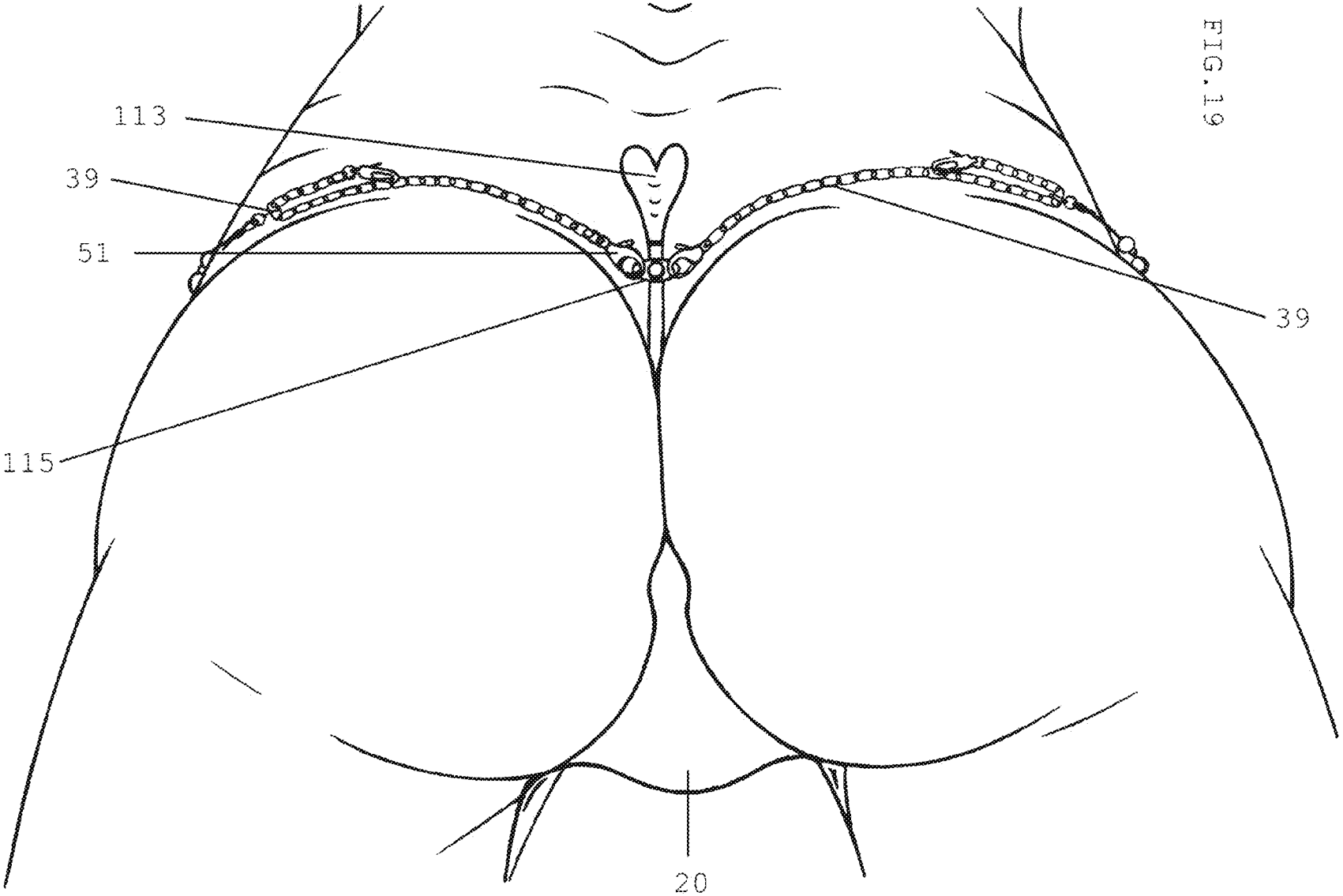
FIG. 19 is a schematic rear view of the strap of FIG. 18, attached to the sportswear or swimwear garment of FIG. 9 and in situ on the wearer.
Figure 20:
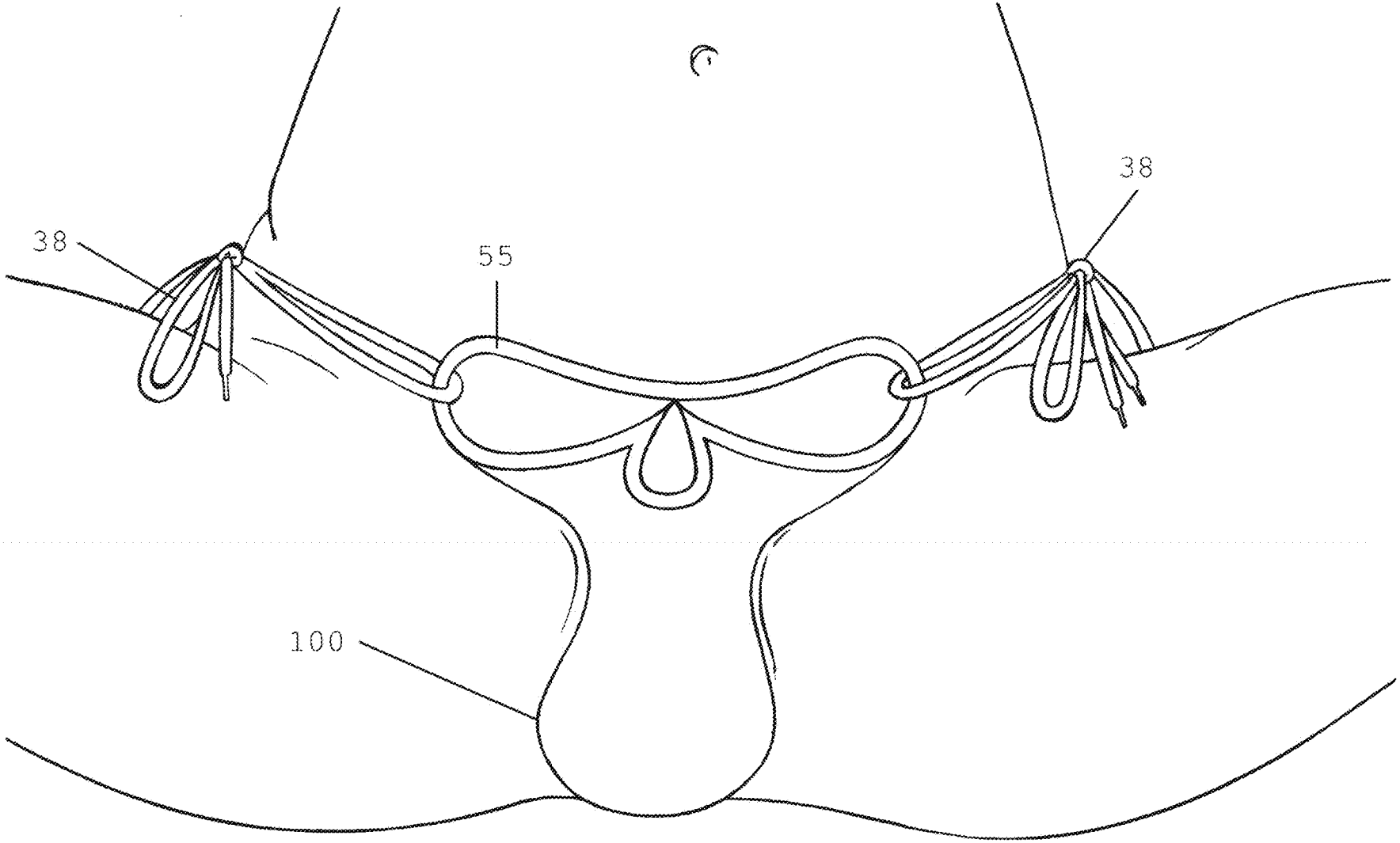
FIG. 20 is a schematic front view of a third embodiment of a strap, attached to a variation of the sportswear or swimwear garment of FIG. 1.
Figure 25:
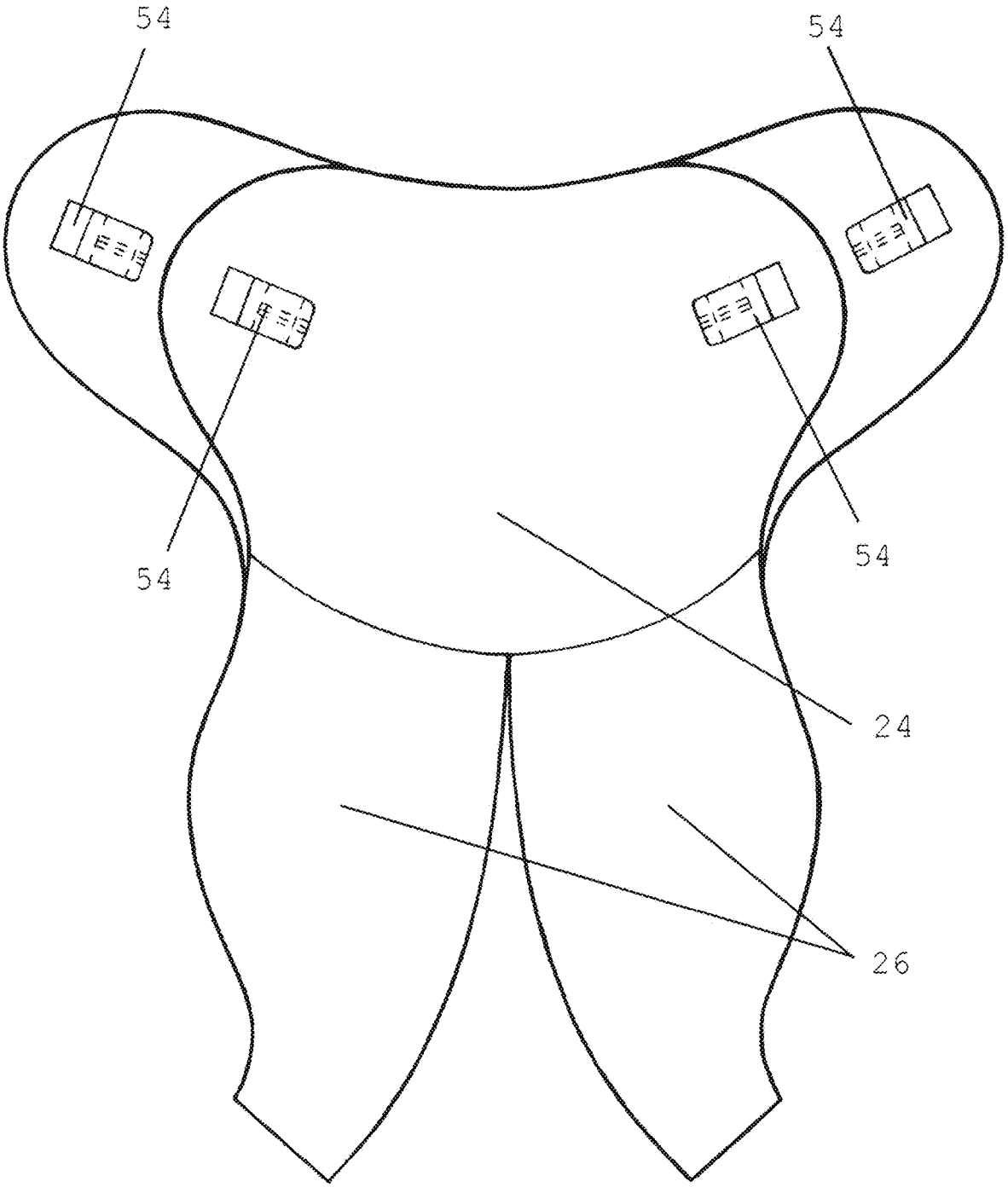
FIG. 25 is a plan view of a template for a first section of the interior fabric covering of the first and second embodiment of the underwear, sportswear or swimwear garment, prior to being attached to the structural frame, including reinforced webbing loop connectors.

As seen in FIGS. 15*a* and 15*b*, the sportswear or swimwear garment 100 includes a welded pin at a right angle to the main shaft of the insert pin 114, adjacent the protective end piece 113. An open circular ring at the end of the welded pin 117 is attached to a pivoting oval shaped ring 115 having a fixed circular plate in the centre thereof. The pivoting oval shaped ring 115 has apertures 116*a*, 116*b* which can receive hook ends of optional swimwear straps, for example swimwear straps 38 or 39 seen in FIGS. 18-20. The swimwear straps 39 shown in FIGS. 18 and 19 each consist of a monofilament line 47 having a plurality of decorative elements 50 dispersed therealong, a flat triangular open hook 49 at an anterior end thereof and a clasp type fastener 51 at a posterior end thereof. The clasp type fastener 51 is attached to an adjustable chain that is in turn attached to a posterior end of the monofilament line 49. The open hook 49 is adapted to be attached to reinforced webbing loop connectors 54 sewn into the fabric covering 20, as shown in FIG. 25 and described below. The clasp type fastener 51 is adapted for fastening onto the pivoting oval shaped ring 115 of the garment 100, the chain being adjustable to fit the particular wearer. The open hooks 49 and the clasp type fastenings 51 are made of marine grade 316 stainless steel. The swimwear straps 38 shown in FIG. 20 consist of nylon weft knitted waterproof laces having tapered ends. The laces can be passed through the reinforced webbing loop connectors 54 at the anterior of the garment 100 and through the pivoting oval shaped ring 115 at the posterior of the garment 100, and tied in a bow at the side of the garment in a manner similar to tying shoelaces. FIG. 20 shows a variant on the sportswear or swimwear garment 100 in which the fabric covering 20 includes a looped structure 55 through which the straps 38 can be passed as an alternative to the reinforced webbing loop connectors 54 described with reference to FIG. 25 below. FIGS. 16*a*, 16*b*, 17*a* and 17*b* show partial views of a further embodiment of optional straps for use with the sportswear or swimwear garment. The strap 31 comprises of a reinforced nylon webbing of the type used in conventional bra straps, which is unaffected by salt or freshwater. Loop eye ends, seen in FIG. 17*b*, are used for attachment to the interior anterior face of the garment fabric covering 20.

Figure 21:
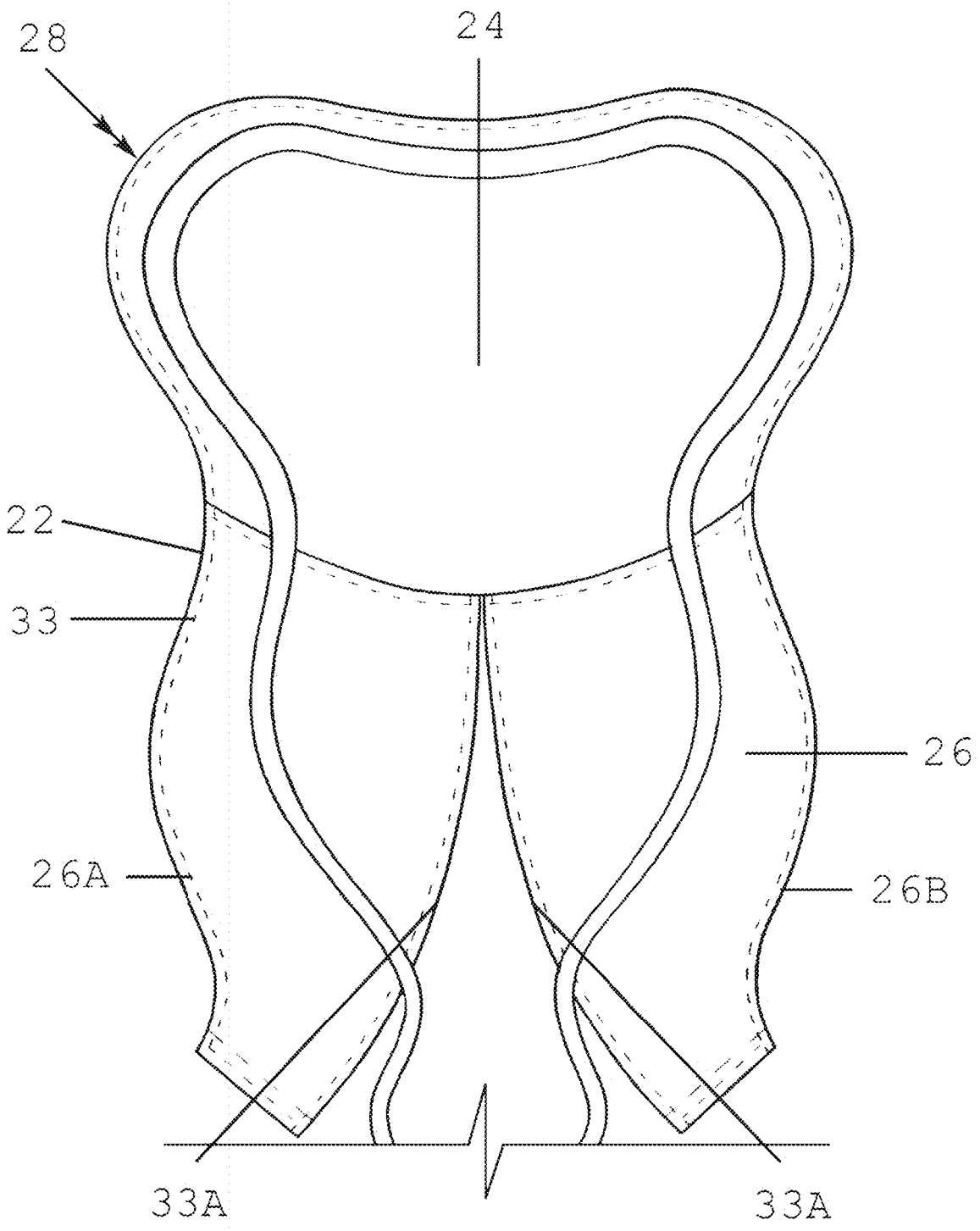
FIG. 21 is a plan view of a template for a first section of the fabric covering of the first embodiment of the underwear, sportswear or swimwear garment, prior to being attached to the structural frame of the underwear, sportswear or swimwear garment, superimposed over the structural frame.

FIGS. 21 to 25 show templates for the fabric covering 20. The fabric covering 20 of the first and second embodiments of the underwear garment 1, 100 comprises of an outer fabric layer 22, an inner lining 24 and an interior absorbent protective layer 26. The covering 20 is made from three separate two-dimensional templates 28; 128 shown in FIGS. 21 and 22 for the first and second embodiments respectively, and templates 48 and 58 shown in FIGS. 23 and 24. FIG. 21 shows the template 28 for each layer 22, 24, 26 for the first embodiment of the underwear, sportswear or swimwear garment. The outer fabric layer 22 and the inner lining 24 extend over the whole template 28 whilst the interior absorbent protective layer 26 extends over only that part of the fabric covering that will cover the labia majora as described below. The outer fabric 22 is made of a soft combed cotton material. The inner lining 24 including interior absorbent layer 26 is made of hypoallergenic organic cotton wicking material designed to wick moisture away from the body, ensuring toxins found in sweat can travel away from the body and for keeping the temperature at a comfortable level for the wearer. The template 28 has an outer perimeter shape that is slightly larger than and generally corresponding to the perimeter of the anterior portion 30 of the structural frame 10 such that the frame 10 can be sewn into the outer edges of the template 28 along the stitching lines 33. The interior absorbent layer 26 comprises of two pieces of material that are separated along an axis of symmetry of the template and curve outwardly therefrom such that when joined together along the sagittal plane form a pouch generally matching the curvature of the labia majora/vulva region of the wearer. The pouch ensures that the labia region is covered and not under pressure from the fabric and ensures that the position of the frame surrounding the pelvic brim is maintained. The pouch also creates a cool environment by minimizing fabric cling. Outer edges 26*a*, 26*b* of the two pieces of material are contoured to correspond with the perimeter of the contoured loop 15 of the structural frame 10 at the inferior portion 40 of the structural frame 15. The inner edges 27*a*, 27*b* of the two pieces of material are sewn together along the stitching line 33*a* to form the pouch. In an embodiment, the template 28 perimeter can be programmed into a CAD program allowing automated laser cutting of the material, providing a high level of accuracy and sealing the fabric at the cutting edge, minimizing fraying of the material.

Figure 22:
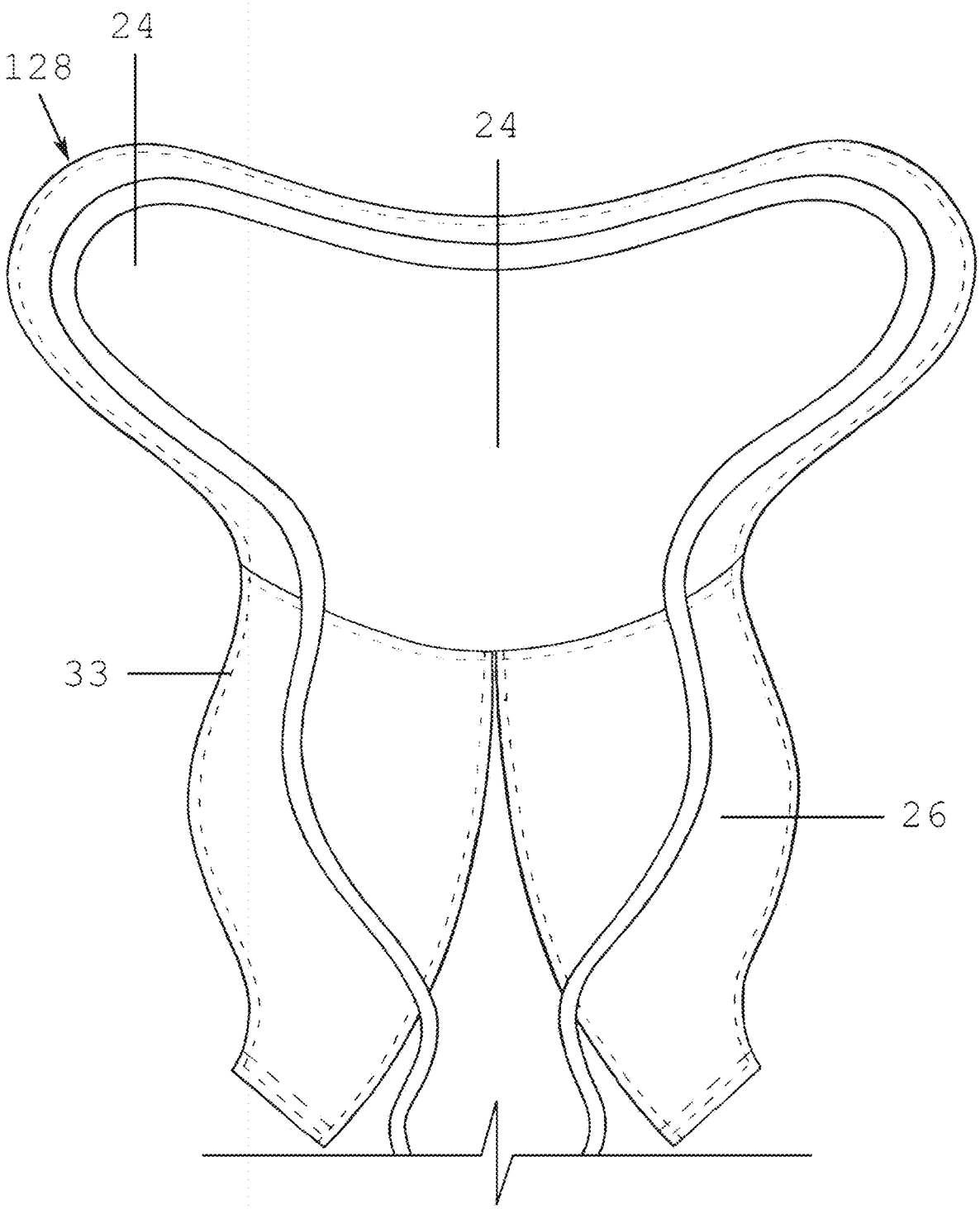
FIG. 22 is a plan view of a template for a first section of the fabric covering of the underwear sportswear or swimwear garment of the second embodiment, prior to being attached to the structural frame of the underwear, sportswear or swimwear garment, superimposed over the structural frame.

FIG. 22 shows a template 128 for a first anterior section of the second embodiment of the garment. It is identical to the template 28 but for the portion of the template intended to cover the extended anterior winglets 106, 107 of the second embodiment. The template 128 is accordingly proportionally extended to accommodate the larger anterior winglets.

Figure 23:
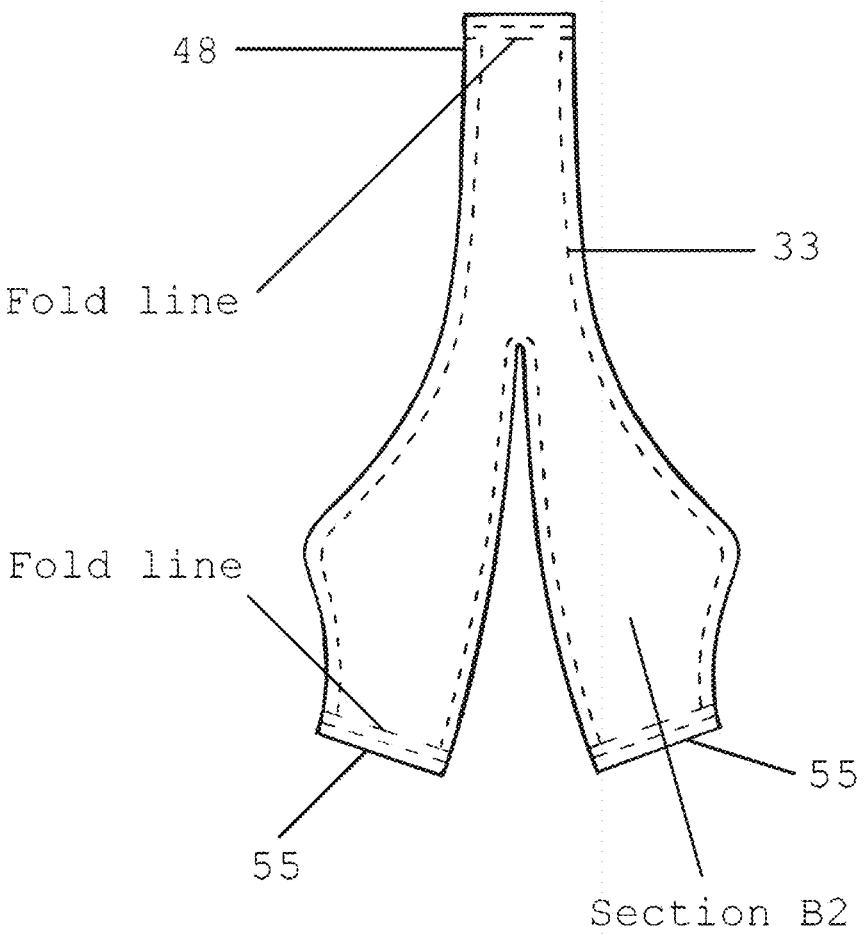
FIG. 23 is a plan view of a template for a second section of the fabric covering of the first embodiment of the underwear, sportswear or swimwear garment.

FIG. 23 shows the template 48 for a portion of the fabric covering 20 adapted for covering the anal region of the wearer. The template 48 is for the outer fabric layer 22 and inner lining 24 of the covering 20. The template 48 has an inverse Y shape having proximal ends 55 that are two separate wings of material adapted for joining to the distal ends of the template 28 or 128 and which have the same width as the narrow distal ends of the template 28 or 128 respectively. The two separate wings of material are adapted to extend over the posterior winglets of the structural frame 10, providing coverage for the sphincter muscle surrounding the anus of the wearer. The winglet portion of each branch is approximately three times the width of the anal opening when the user is in an extreme posture, for example with widely spread legs, to ensure coverage of the anus and also to provide sufficient space for heat from the body to escape freely. When worn, the position of the posterior winglet is vertically higher than the position of the vaginal region, creating a chimney like effect for the dissipation of heat that may build up in the vaginal region. The template is sewn together along the curve of the two branch pieces to create a three-dimensional shape to the second section of the fabric covering 20.

Figure 24:
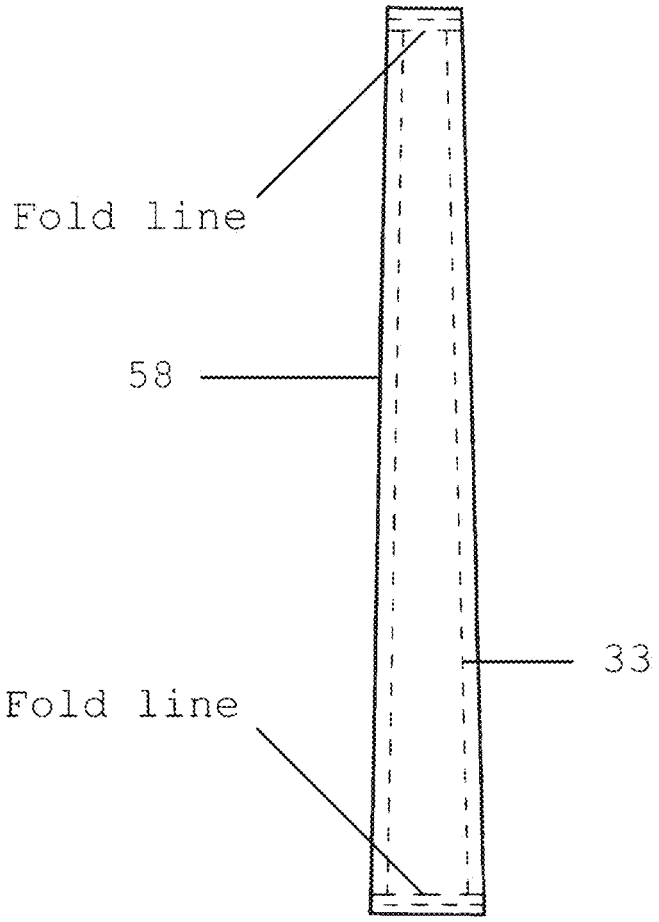
FIG. 24 is a plan view of a template for a third section of the fabric covering of the first embodiment of the underwear, sportswear or swimwear garment.

FIG. 24 shows the template 58 for the fabric covering 20 for the single stem 12 of the structural frame 10. The template 58 is for the outer fabric layer 22 and inner lining 24 of the covering 20. The template 58 is an elongate strip of material that tapers outwardly from a narrow distal portion to a slightly wider proximal portion that is adapted for sewing to the template 48 once formed. The template 58 extends over the length of the single stem 12 for the comfort of the wearer.

Once the templates 28 or 128, 48 and 58 are formed into the three sections of fabric covering 20, they are assembled together and fitted over the structural frame 10 and stitched in place over it.

As seen in FIG. 25, reinforced webbing loop connectors 54 can be provided at the left and right sides of the internal lining 24 in some embodiments of the fabric covering 20 as points of attachment for the flat hooks 49 of the optional straps 39 when the garment 100 is used as sportswear and swimwear. Alternatively, the connectors can be used as points of attachment for the waterproof nylon lace up strap 38 of the swimwear garment 100.

The underwear, sportswear or swimwear garment 1, 100 can be made in various sizes according to international standard sizing for female underwear as is known in the garment industry. For example, a female having a waist measurement of 61-71 cm and a hip measurement of 86-96 cm is a standard US/Canadian size 4-6, a UK/Australian 8-10, a European size 36-38 and an international size XS-S. A female having a waist measurement of 71-28 cm and a hip measurement of 86-96 cm is a standard US/Canadian size 8-10, a UK/Australian 12-14, a European size 40-42 and an international size M-L. The dimensions of the structural frame and its curvature are arrived at by casting moulds of the mons pubis area, labia and genital regions and the intergluteal cleft of a female whose body size fits the standard dress sizing for each standard size, so that the structural frame of the underwear garment closely fits the anatomy of the wearer.

The underwear, sportswear or swimwear garment is, in both the first and second embodiments, designed to be maintained in place on the wearer by the contoured shape and spring biasing of the structural frame. The inferior portion of the frame has a perimeter that is shaped to cover the labia majora. Rearwardly of the vagina, the perimeter shape curves convex inward. Rearward of this, the posterior winglets curve convex outward. The positive and negative curvature of the perimeter of the frame between the vaginal and anal regions, which are adapted to fit the anatomy of the wearer, ensures that the garment will not slip backwards and forwards during normal movement. As a result, the part of the garment that covers the vaginal region remains separated from the part of the garment that covers the anal region, preventing the risk of cross contamination between bacteria stemming from the anal cavity to the vaginal canal. Currently there is no conventional thong or G-string type underwear in the global marketplace which can ensure this.

Although the invention has been described with reference to specific examples, it will be appreciated by those skilled in the art that the invention may be embodied in many other forms.

The invention claimed is:

1. An underwear, sportswear or swimwear garment for a female wearer, comprising an open-sided structural frame and a fabric covering for the structural frame, the structural frame including an anterior contoured loop and a posterior stem, the anterior contoured loop and the posterior stem being relative to an anterior and posterior of the female wearer of the garment, respectively, in normal use, wherein the anterior contoured loop is adapted for surrounding a mons-pubis region, genitals and anus of the female wearer and has a perimeter that is contoured to conform to and engage with anatomy of the female wearer; wherein a portion of the perimeter of the anterior contoured loop is adapted for tensioned engagement with inner thigh muscles of the female wearer under compressive force applied to the perimeter by the inner thigh muscles of the female wearer when worn, in a standing position or whilst walking; wherein the posterior stem is shaped so as to be engageable by gluteus maximus muscles of the female wearer when worn; and wherein the anterior contoured loop and the posterior stem are formed in a spring-biased arrangement relative to one another such that when the underwear, sportswear or swimwear garment is worn on the female body, a tensile force is transferrable from the posterior stem to the anterior contoured loop, wherein the perimeter of the anterior contoured loop comprises an anterior portion adapted for surrounding the mons-pubis region and an inferior portion adapted for surrounding a labia majora and the anus; wherein the inferior portion of the perimeter includes a parabolic curvature having positive and negative curvature adapted for engagement with the anatomy of the female wearer between a vaginal and anal region of the female wearer.

2. The underwear, sportswear or swimwear garment according to claim 1, further comprising a protective end piece at a distal end of the posterior stem, the protective end piece being adapted for engagement with a superior extent of an intergluteal cleft of the female wearer for prevention of substantial downward movement of the underwear, sportswear or swimwear garment when worn on the female wearer.

3. The underwear, sportswear or swimwear garment according to claim 2, wherein the protective end piece is heart shaped.

4. The underwear, sportswear or swimwear garment according to claim 3, wherein the protective end piece is made of medical grade silicone or ultraviolet stabilized polyurethane reinforced with a 316 marine grade stainless steel pin.

5. The underwear, sportswear or swimwear garment according to claim 1, wherein the anterior portion comprises an upper concave portion flanked by left and right side anterior winglets adapted for engaging lateral extent of the mons-pubis region, and a lower tapered portion adapted to fit the mons-pubis of the female wearer.

6. The underwear, sportswear or swimwear garment as claimed in claim 1, wherein the inferior portion of the perimeter is adapted for spring biased engagement with the inner thigh muscles of the female wearer upon the compressive force being exerted on the perimeter by the wearer when worn on the female wearer.

7. The underwear, sportswear or swimwear garment according to claim 1, wherein the inferior portion includes a pair of left- and right-side posterior winglets adapted for surrounding a sphincter muscle region surrounding the anus.

8. The underwear, sportswear or swimwear garment according to claim 7, wherein the posterior stem is formed from merging of left- and right-side portions of the inferior portion of the contoured loop posterior of the left- and right-side posterior winglets, the posterior stem including a protective end piece, the posterior stem and the protective end piece being adapted for conformity with an intergluteal cleft and curve of a tail bone of the female wearer.

9. The underwear, sportswear or swimwear garment as claimed in claim 1, wherein the structural frame is formed from a single piece of injection molded material.

10. The underwear, sportswear or swimwear garment as claimed in claim 9, wherein the structural frame is formed from polycarbonate.

11. The underwear, sportswear or swimwear garment as claimed in claim 1, wherein the fabric covering is made of cotton.

12. The underwear, or swimwear garment as claimed in claim 1, further comprising a protective end piece at a distal end of the posterior stem, the protective end piece being adapted for engagement with a superior extent of an intergluteal cleft of the female wearer for the prevention of substantial downward movement of the underwear, sportswear or swimwear garment when worn on the female wearer, wherein the anterior portion comprises an upper concave portion flanked by left and right side anterior winglets adapted for engaging lateral extent of the mons-pubis region, and a lower tapered portion adapted to fit the mons-pubis of the female wearer, and including one or more straps for joining the anterior winglets to the protective end piece.

* * * * *